US006814123B2

(12) United States Patent
Erickson

(10) Patent No.: US 6,814,123 B2
(45) Date of Patent: Nov. 9, 2004

(54) METHOD AND APPARATUS FOR APPLYING A SPLICING TAPE TO A ROLL OF SHEET MATERIAL

(75) Inventor: Leif O. Erickson, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 87 days.

(21) Appl. No.: 10/028,659

(22) Filed: Dec. 21, 2001

(65) Prior Publication Data

US 2003/0116256 A1 Jun. 26, 2003

(51) Int. Cl.[7] ..... B32B 31/00; B65H 81/00

(52) U.S. Cl. ..... 156/450; 156/157; 156/504; 242/555.3; 242/562; 242/910

(58) Field of Search ..... 156/159, 502, 156/504, 450, 157; 242/551, 553, 555.3, 555.4, 556.1, 562, 910

(56) References Cited

U.S. PATENT DOCUMENTS

| | | | | |
|---|---|---|---|---|
| 3,520,748 A | * | 7/1970 | Riegger | 156/159 |
| 3,533,891 A | | 10/1970 | Puyear | |
| 3,549,098 A | | 12/1970 | Helkala et al. | |
| 3,568,944 A | | 3/1971 | Besserdich | |
| 3,670,980 A | | 6/1972 | Mukai et al. | |
| 3,857,524 A | | 12/1974 | Melead et al. | |
| 3,889,892 A | | 6/1975 | Melead | |
| 4,171,780 A | | 10/1979 | Bugnone | |
| 4,264,401 A | * | 4/1981 | Ganz | 156/504 |
| 4,597,820 A | * | 7/1986 | Nozaka | 156/353 |
| 4,778,119 A | | 10/1988 | Yamazaki et al. | |
| 5,039,023 A | | 8/1991 | Hagens et al. | |
| 5,277,731 A | * | 1/1994 | Krimsky et al. | 156/159 |
| 5,318,656 A | * | 6/1994 | Dylla et al. | 156/357 |
| 5,320,698 A | | 6/1994 | Fournier et al. | |
| 5,322,230 A | * | 6/1994 | Dylla et al. | 242/553 |
| 5,330,125 A | * | 7/1994 | Dylla | 242/562 |
| 5,386,950 A | | 2/1995 | Abt | |
| 5,524,844 A | * | 6/1996 | McCormick et al. | 242/562 |
| 5,901,919 A | | 5/1999 | Wienberg | |
| 5,916,651 A | | 6/1999 | Wienberg et al. | |

FOREIGN PATENT DOCUMENTS

| | | |
|---|---|---|
| CA | 2025473 A1 | 3/1991 |
| CA | 2069247 A1 | 12/1992 |
| CA | 2277010 | 1/2000 |
| CA | 2296932 | 7/2000 |
| DE | 2 331 125 | 8/1974 |
| DE | 2 318 353 | 10/1974 |
| DE | 2 337 663 A1 | 2/1975 |
| DE | 31 12775 A1 | 10/1982 |
| DE | 3 402 582 A1 | 8/1985 |
| DE | 35 23 139 | 2/1987 |
| DE | 36 14 284 A1 | 10/1987 |
| DE | 42 33 521 A1 | 4/1994 |
| DE | 296 24 000 | 8/2001 |
| EP | 0 181 280 A1 | 5/1986 |
| EP | 0 418 527 A2 | 3/1991 |
| EP | 0 512 196 B1 | 11/1992 |
| EP | 0 349 350 B1 | 2/1993 |
| EP | 0 941 954 A1 | 9/1999 |
| EP | 1 041 025 | 10/2000 |

(List continued on next page.)

*Primary Examiner*—Mark A. Osele

(57) ABSTRACT

Methods and apparatus for applying a flying splicing tape to a roll of sheet material. A preferred embodiment of the invention provides methods and apparatus for lifting a portion of the outer-most layer of sheet material away from a roll of sheet material to form a lifted portion of the outer-most layer, applying a splicing tape to a wound portion of the roll, and applying pressure to the lifted portion of the outer-most layer to progressively place the lifted portion of the outer-most layer in contact with the remainder of the roll and the splicing tape.

10 Claims, 20 Drawing Sheets

FOREIGN PATENT DOCUMENTS

| | | | |
|---|---|---|---|
| GB | 2 025 376 | A | 1/1980 |
| GB | 2 177 067 | A | 1/1987 |
| GB | 2257931 | A | 1/1993 |
| GB | 2294235 | A | 4/1996 |
| GB | 2335913 | A | 10/1999 |
| JP | 59-207371 | | 11/1984 |
| JP | 61-132218 | | 6/1988 |
| JP | 3-272956 | | 12/1991 |
| JP | 07-101618 | A | 4/1995 |
| JP | 11-334981 | A | 12/1999 |
| JP | 2000-038552 | | 2/2000 |
| JP | 2000-313562 | A | 11/2000 |
| WO | WO 95/29115 | | 11/1995 |

* cited by examiner

METHOD AND APPARATUS FOR APPLYING A SPLICING TAPE TO A ROLL OF SHEET MATERIAL

THE FIELD OF THE INVENTION

The present invention relates to methods and apparatus for applying a splicing tape to a roll of sheet material. More particularly, the present invention relates to methods and apparatus for lifting a portion of the outer-most layer of sheet material away from a roll of sheet material to form a lifted portion of the outer-most layer, applying a splicing tape to a wound portion of the roll, and applying pressure to the lifted portion of the outer-most layer to progressively place the lifted portion of the outer-most layer in contact with the remainder of the roll and the splicing tape.

BACKGROUND OF THE INVENTION

With most high volume printing applications, for example printing of newspapers, the sheet material to be printed on (e.g., paper) is provided to a handling station in a large wound roll. During printing, the sheet material is continuously unwound and fed from the roll, via the handling station, to a printing device. Over time, the sheet material supplied by the roll will be depleted, such that the roll must be replaced with a new roll of appropriate sheet material. As would be expected, manufacturers/publishers wish to minimize, as much a possible, the complications and delays associated with changing from a depleted roll to the new roll. To this end, techniques have been developed by which a leading end (or outermost layer) of the new roll is joined to a trailing portion (or innermost layer) of the depleting roll, effectuating a nearly seamless transition from the depleted roll to the new roll at the handling station.

More particularly, splicing tapes can be employed to prepare a joint between the leading end of the new roll and the trailing portion of the depleting roll. The splicing operation can be performed in a static or dynamic mode. In general terms, the static mode entails stopping rotation of the old roll, applying a tape to one or both of the rolls, and then forming a joint there between. Splices that are formed in a static mode are commonly referred to as zero speed splices. Conversely, the dynamic mode prepares a splice without requiring interruption of the continuous production/printing process. That is to say, both the depleting roll and the new roll continue to rotate as the splice is formed. Splices that are obtained in a dynamic mode of operation are usually referred to as flying splices.

A wide variety of splicing tapes are currently available for forming a flying splice. Regardless of the exact form, the flying splice tape is initially adhered to an outer layer of the new roll, with at least a portion of the splicing tape being exposed for subsequent connection to the trailing portion of the depleting roll. A further constraint is that for flying splice applications, the new roll must be provided to the handling station in wound form, so that when the new roll is subsequently rotated in conjunction with the depleting roll, the new roll will not unexpectedly unwind. Thus, the flying splice tape is applied to the new roll in such a way that an outer-most layer of the new roll is secured or otherwise maintained against a second outer-most layer, ensuring that the new roll remains wound prior to splicing.

The particular form of the flying splicing tape typically dictates the manner in which it is initially applied to a new roll of sheet material. For example, some types of splicing tape include destructible nose tabs, such as that described in WO 95/29115, and are applied in a W or V shape. This format is not conducive to automated application. Conversely, the flying splicing tape can assume a form requiring that the leading edge of the outer-most layer be cut at an angle (relative to an axis of the roll), for example as described in U.S. Pat. No. 4,802,632.

These, and other types of splicing tapes, have proven to be quite viable. However, improvements are continually being pursued. To this end, flying splicing tapes have been developed that are applied in a straight line (relative to an axis of the roll) along an outer surface thereof. Due to the straight line of application, these types of splicing tapes are conducive to automated application. For example, U.S. Pat. No. 5,783,029 describes an automated splicing tape applicator that includes a working carriage that cuts a leading edge of the outermost layer and simultaneously applies spaced adhesive labels and a double sided adhesive splice tape across a width of the roll. As shown in FIG. 3 of U.S. Pat. No. 5,783,029, the spaced adhesive labels are quite large, and are positioned to secure the wound outer surface onto itself. The splicing tape is formed over the adhesive labels. Due to this particular application, there is little concern for precisely cutting/locating the leading edge relative to a remainder of the roll, as the adhesive labels easily compensate for any alignment errors.

A more recently developed splicing tape is described in U.S. patent application Ser. No. 09/770,985, filed Jan. 26, 2001 and entitled "Tape For Flying Splice, Method Of Use, And Method Of Manufacture," assigned to the same assignee and the teachings of which are incorporated herein by reference. The so-described splicing tape is generally referred to as being a "separable splicing tape" as it includes inner and outer tape elements releasably secured to one another by a separable intermediate layer. The inner tape element is secured to the roll at the intersection of the outer-most layer and the second outer-most layer (i.e., beneath the leading edge of the outer-most layer). The leading edge of the outer-most layer is adhered to an outer surface of the outer tape element. More particularly, the leading edge is positioned such that the outer-most layer encompasses a portion of the outer tape element (preferably, though not necessarily, along an entire width thereof), with a remainder of the outer tape element being "exposed". Subsequently, the trailing portion of the depleting roll is adhered to this exposed portion of the outer tape element, thereby splicing the two rolls. As the outer-most layer of the new roll is pulled away from, or otherwise forcibly unwound from the roll, the outer tape element releases or "separates" from the inner tape element so that the new roll can then be fully unwound.

The above-described separable splicing tape represents a distinct advancement in the flying splice tape art. However, certain application difficulties not otherwise found with many other types of splicing tapes render automatic application of the separable splicing tape difficult, especially on a mass production basis. First, unlike most other splicing tapes, the separable splicing tape must be applied between the leading edge of the outer-most layer and a remainder of the roll. Thus, the outer-most layer must be partially unwound, the splicing tape applied, and then the leading edge pressed into contact with the splicing tape. Second, on a related point, the separable splicing tape is preferably quite narrow. Thus, registration of the leading edge, that is otherwise partially unwound, relative to the location at which the splicing tape is to be applied is highly important. By way of example, the separable splicing tape may have a width on the order of 1½ inch (3.81 cm). Because a portion of this width must be available for subsequent engagement with the trailing portion of the depleting roll, there is little room for error when locating the tape along the roll relative to a point at which the leading edge will be located when subsequently reapplied. Additional concerns, such as removal of at least a section of a release liner sometimes provided on top of the outer tape element, precise cutting of the splicing tape relative to a side of the roll, etc., are also raised by separable splicing tapes.

In light of the above constraints, separable splicing tapes are currently applied manually. After loading the roll into a loading station, a leading section of the outer-most layer is allowed to freely extend or unwind from a remainder of the roll. The leading section is pulled away from the roll such that an outer surface of the remaining wound portion is accessible. The separable splicing tape, including an outer release liner, is then placed across the wound portion of the roll at a location that is clearly inside of the unwound leading section. Notably, because the splicing tape is applied by hand, it is oftentimes difficult to achieve a "straight" orientation (parallel to a central axis of the roll). Regardless, a portion of the release liner is then removed. The unwound leading section of the outer-most layer is then re-wound to the roll and adhered to the splicing tape. Assuming the splicing tape has been properly located, a portion (or tail) of the outer-most layer will continue to extend from the roll, beyond the point of interface with the splicing tape. This tail material is folded back at the point of interface with the splicing tape, forming a crease. The tail material is then cut from the roll along the crease. Unfortunately, it is virtually impossible for the new leading edge defined by the cut to be precisely formed and located relative to the exposed area of the splicing tape, possibly leading to problems during a subsequent splicing operation. Further, difficulties may be encountered when attempting to lay the leading section of the outer-most layer against the splicing tape. In fact, due to unavoidable human errors, the cut/leading edge may be so displaced relative to the splicing tape and/or creases formed at the point of interface that the resulting arrangement cannot be used. In this case, a length of the sheet material, including that portion to which the splicing tape is adhered, must be removed and discarded, and the process repeated.

Separable splicing tapes, as well as other splicing tapes applied in either a straight across fashion and/or beneath a leading edge of the outer-most layer, provide many advantages to users. However, existing automated applicators cannot satisfy the many application constraints presented by these splicing tapes when used for flying splices. Further, manual application is less than optimal. Therefore, a need exists for an apparatus and method of consistently and automatically applying a splicing tape, especially a separable splicing tape, to a roll that properly cuts and locates the leading edge of the applied splicing tape in a suitable configuration for a flying splice.

SUMMARY OF THE INVENTION

One aspect of the present invention provides a method of applying a splicing tape to a roll of sheet material. This method comprises: lifting a portion of an outer-most layer away from a remainder of the roll to form a lifted portion of the outer-most layer; applying the splicing tape to a wound portion of the roll; and applying pressure to the lifted portion of the outer-most layer to progressively place the lifted portion of the outer-most layer in contact with the remainder of the roll and the splicing tape. In one embodiment of the above method, the lifting step includes lifting the portion of the outer-most layer away from the remainder of the roll with a sheet engagement mechanism, and the step of applying pressure to the lifted portion includes applying pressure to disengage the lifted portion from the sheet engagement mechanism. In one aspect of this embodiment, the sheet engagement mechanism includes a vacuum source for lifting the portion of the outer-most layer away from the remainder of the roll.

In another embodiment of the above method, the applying pressure step includes applying pressure with a paper applicator to the lifted portion of the outer-most layer to progressively place the lifted portion of the outer-most layer in contact the remainder of the roll and the splicing tape. In one aspect of this embodiment, the paper applicator includes a roller, and wherein the applying pressure step includes progressively pressing the roller along the outer-most layer and the splicing tape.

In another embodiment of the above method, the method further comprises cutting the lifted portion of the outer-most layer to form a leading edge of the roll, wherein the applying pressure step includes applying pressure to the lifted portion of the outer-most layer to apply the leading edge of the roll to the splicing tape. In another embodiment of the above method, the splicing tape has a first section and a second section, wherein the outer-most layer covers the first section of the splicing tape and the second section of the splicing tape remains exposed adjacent the outer-most layer. In another embodiment of the above method, the method further comprises holding down a portion of the outer-most layer as the lifted portion of the outer-most layer is lifted away from the remainder of the roll.

Another aspect of the present invention provides an apparatus for applying a splicing tape to a roll of sheet material. This apparatus comprises: a sheet engagement mechanism to lift an outer-most layer of the roll to form a lifted portion of the outer-most layer; a taping device to apply a splicing tape to the roll; and a paper applicator to apply pressure to the lifted portion of the outer-most layer to progressively place the lifted portion of the outer-most layer in contact with the remainder of the roll and the splicing tape. In one embodiment of the above apparatus, paper applicator applies pressure to disengage the lifted portion from the sheet engagement mechanism. In another embodiment of the above apparatus, the paper applicator includes a roller for rolling along the lifted portion of the outer-most layer to disengage the lifted portion of the outer-most layer from the sheet engagement mechanism and to progressively press the roller along the outer-most layer and the splicing tape.

In another embodiment of the above apparatus, the apparatus further comprises a sheet cutter to cut the outer-most layer of the roll across a width thereof. In yet another embodiment of the above apparatus, the sheet engagement mechanism includes a vacuum source for lifting the portion of the outer-most layer away from the remainder of the roll. In another embodiment of the above apparatus, the paper applicator holds down a portion of the outer-most layer as the lifted portion of the outer-most layer is lifted away from the remainder of the roll by the sheet engagement mechanism.

In yet another embodiment of the above apparatus, the splicing tape has a first section and a second section, wherein the outer-most layer covers the first section of the splicing tape and the second section of the splicing tape remains exposed adjacent the outer-most layer. In another embodiment of the above apparatus, the taping device further includes a press down roller for pressing the outer-most layer against an outer surface of splicing tape after the paper applicator applies the lifted portion of the outer-most layer to the splicing tape.

Another aspect of the present invention provides an apparatus for engaging a roll of sheet material. This apparatus comprises: a plurality of sheet engagement mechanisms to engage and lift an outer-most layer of the roll to form a lifted portion of the outer-most layer, wherein each sheet engagement mechanism includes a vacuum source and a roll sensor for sensing a spatial position of the roll relative to the sheet material engagement mechanism, wherein each vacuum source only operates when a selected plurality of the roll sensors sense the roll relative to the sheet engagement mechanism. In one embodiment of the above apparatus, each vacuum source includes a plurality of vacuum cups.

DESCRIPTION OF THE PREFERRED EMBODIMENTS

Figure 1A:
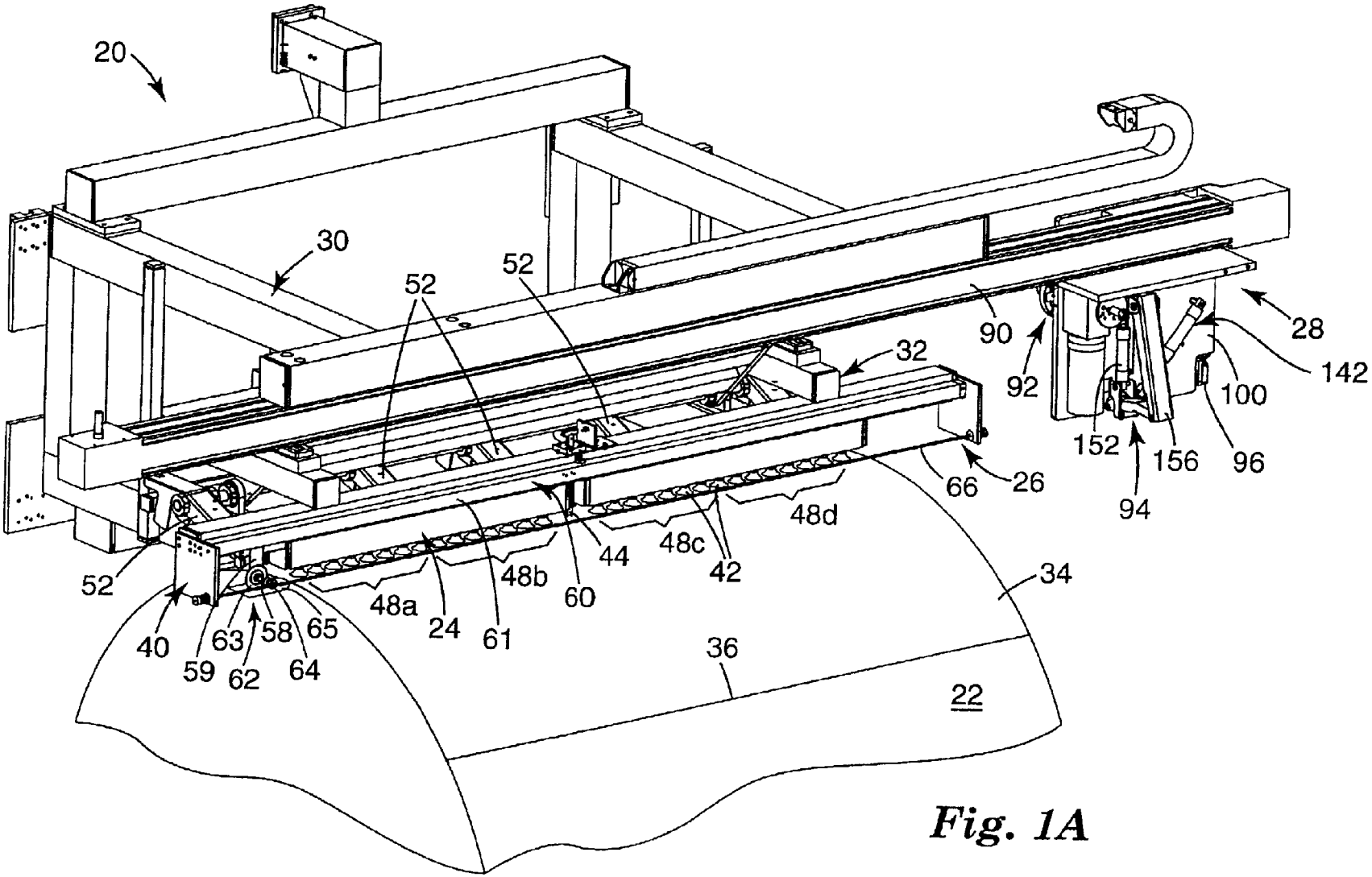
FIG. 1A is a front perspective view of an automated splicing tape applicator in accordance with the present invention positioned over a roll of sheet material.
Figure 1B:
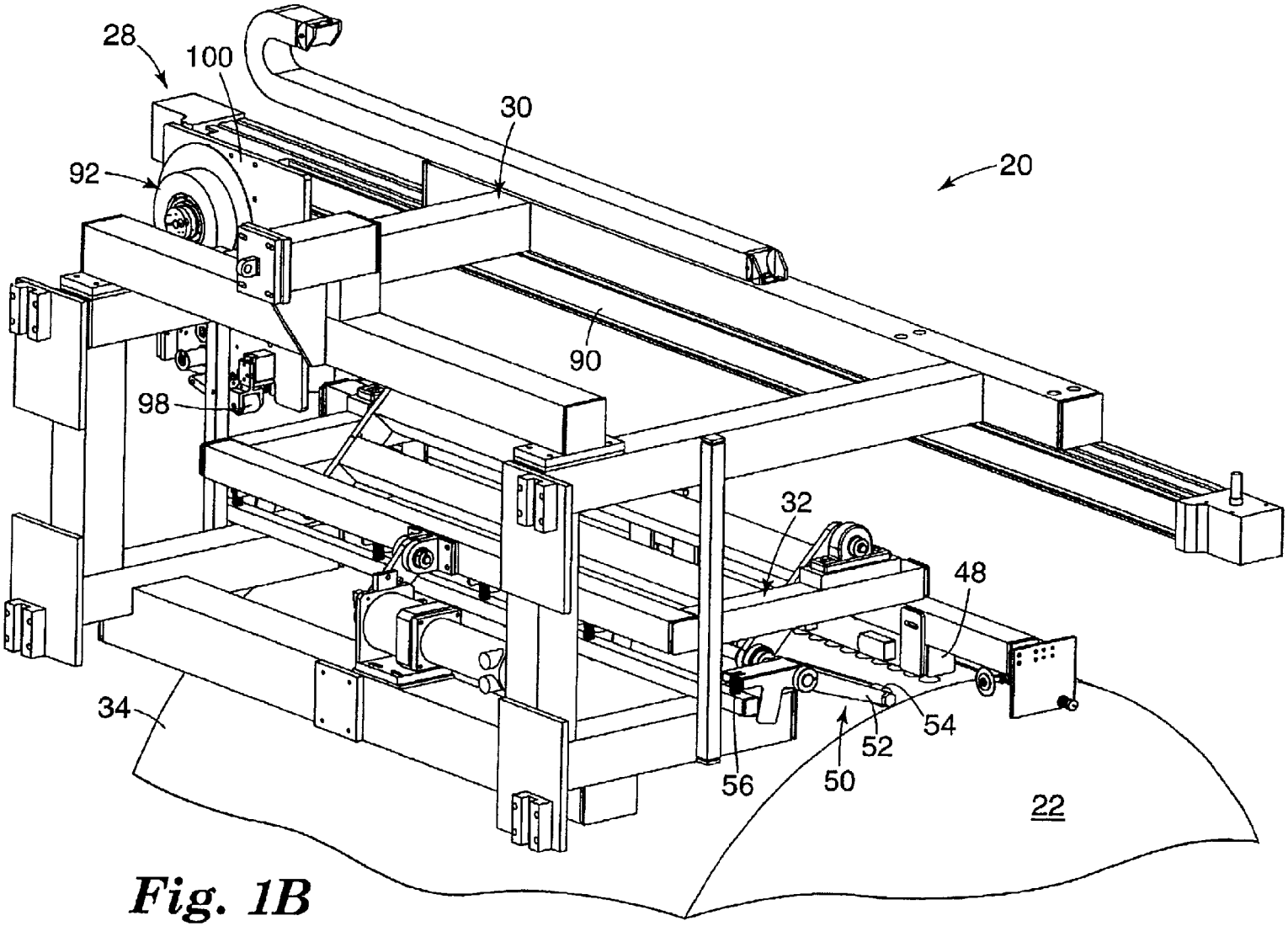
FIG. 1B is a rear perspective view of the applicator of FIG. 1A.

One preferred embodiment of an automated splicing tape applicator 20 is shown in FIGS. 1A and 1B. As a point of reference, the applicator 20 is shown in conjunction with a roll of sheet material 22 to be processed by the applicator 20. With this in mind, the applicator 20 includes a sheet engagement mechanism 24, a sheet cutter assembly 26 and a taping device 28. The various components are described in greater detail below. In general terms, however, the sheet engagement mechanism 24, the sheet cutter assembly 26 and the taping device 28 are connected by a frame 30, with the sheet engagement mechanism 24 and the sheet cutter assembly 26 preferably being coupled by a linkage 32 to the frame 30. With this configuration, via the linkage 32, the sheet engagement mechanism 24 and sheet cutter assembly 26 are maneuverable relative to the taping device 28 between a first position in which a cutting line provided by the sheet cutter assembly 26 is aligned with a tape application line provided by the taping device, and a second position in which the sheet cutter assembly 26 is spaced away from the tape application line.

Positioning and use of the various components of the applicator 20 are most conveniently described below with reference to certain elements of the roll 22. To this end, the roll 22 is generally defined to include an outer-most layer 34. Prior to processing by the applicator 20, the outer-most layer 34 is tightly wound to a remainder of the roll 22, terminating at a free or leading end 36. Depending upon the side at which the roll 22 is viewed, the roll 22, including the outer-most layer 34, is wound in either a clockwise or counter-clockwise direction. As used throughout this specification, regardless of winding direction, the leading end 36 of the outer-most layer 34 is referenced as being "upstream." The outer-most layer 34, as well as the remaining inner layers (or turns), can thus be described as being "downstream" of the leading end 36. Finally, the roll 22 defines a first side 160 and a second side 166 (generally hidden in FIGS. 1A and 1B) relative to the direction in which splicing tape (not shown) is applied by the applicator 20. In other words, during operation, the splicing tape is initially applied at or near the first side 160 and then is extended to or near the second side 166.

With the above conventions in mind, and in a preferred embodiment, the sheet engagement mechanism 24 includes a support bar 40, a plurality of vacuum cups 42 and a roll sensor 44. The vacuum cups 42 and the roll sensor 44 are maintained by the support bar 40.

The vacuum cups 42 are of a type known in the art, and are each fluidly connected to a vacuum source (not shown). In a preferred embodiment, the vacuum cups 42 are arranged in a plurality of zones 48*a*–48*d*. With this zoned configuration, the sheet engagement mechanism 24 is able to readily process a variety of different roll widths. As a point of reference, for many printing industry applications where the roll 22 is a comprised of a paper sheet material, "standard" roll widths (or axial length) include 12.25 inches (31.1 cm), 24.5 inches (62.2 cm), and 50 inches (127 cm). The actual width of the roll 22 will dictate which of the zones 48 are activated. For example, where the roll 22 has a width of 50 inches (127 cm), the vacuum cups 42 in all of the zones 48*a*–48*d* will be used (e.g., have a vacuum applied thereto). Conversely, a roll width of 12.25 inches (31.1 cm) requires that only the zones 48*b* and 48*c* be activated. In this regard, a separate programmable controller (not shown) is preferably provided to initiate a vacuum at the desired zones 48*a*–48*d*. Alternatively, the vacuum cups 42 can be arranged into a different number of zones, or all of the vacuum cups 42 can always be activated during use of the applicator 20. Regardless, as described in greater detail below, the vacuum cups 42 all extend downwardly from the support bar 40 (relative to the orientations of FIGS. 1A and 1B) to a common plane.

The roll sensor 44 is of a type known in the art and extends downwardly from the support bar 40, beyond the common plane defined by the vacuum cups 42. The roll sensor 44 is preferably electrically connected to the programmable controller (not shown), and provides a signal thereto upon contacting an outer surface of the roll 22 during use. Upon receiving a signal from the roll sensor 44, the programmable controller initiates the vacuum source (not shown) to form a vacuum at the desired vacuum cups 42. Thus, the roll sensor 44 serves as a switching mechanism, ensuring that processing of the roll 22 by the applicator begins only after the various components are properly positioned relative to the roll 22. As such, the applicator 20 can handle a number of different roll diameters, ranging from, for example, 30–50 inches (76–127 cm).

In one preferred embodiment, the sheet engagement mechanism 24 further includes a hold down device 50. As described in greater detail below, the hold down device 50 serves to prevent overt displacement of an outer-most layer of the roll 22 during processing by the applicator 20, and preferably includes a plurality of arms 52 each maintaining a roller 54. Each of the arms 52 is coupled to the frame 30, and is preferably biased to a lowered position by a spring 56. With this one preferred construction, then, the respective rollers 54 can be maintained in contact with the roll 22 regardless of a position of the linkage 32. Alternatively, a wide variety of other constructions for the hold down device 50 are also acceptable. The contact between the hold down device 50 and the roll 22, specifically at the rollers 54, is positioned so as to be spaced from, and behind or downstream of, the vacuum cups 42. That is to say, the rollers 54 (or other similar roll 22 contact component) are positioned downstream of the vacuum cups 42 relative to the leading end 36 of the outer-most layer 34.

The sheet cutter assembly 26 preferably includes a guide carriage 60 and a blade mechanism 62. The guide carriage 60 guides a cutting surface provided by the blade mechanism 62 along a planar path during a cutting operation, and is preferably coupled to the support bar 40 otherwise maintaining the vacuum cups 42. The cutting surface of the blade mechanism 62 extends downwardly from the guide carriage 60, and is configured to cut the sheet material provided by the roll 22. In this regard, the cutting surface of the blade mechanism 62 preferably extends below the vacuum cups 42 (relative to the orientation of FIGS. 1A and 1B) so that a sheet or layer otherwise engaged by the vacuum cups 42 can be cut by traversing the blade mechanism 62 across the guide carriage 60. Notably, the guide carriage 60, and thus travel distance of the blade mechanism 62, is preferably greater than an overall length defined by the plurality of vacuum cups 42 and an expected width of the roll 22. Thus, in the neutral position of FIGS. 1A and 1B (i.e., prior to a cutting operation), the blade mechanism 62 can be positioned laterally away from the vacuum cups 42, so that the vacuum cups 42 can engage the roll 22 without interference from the blade mechanism 62.

In one preferred embodiment, the blade mechanism 62 includes a rotatable shaft 58, a mounting bracket 59, a linear actuator 61, a rotary sheet cutter 63, a pulley 64, a support shoe 65, and a cable 66. The rotary sheet cuter 63 provides the cutting surface for cutting sheet material. The rotary sheet cutter 63 and the pulley 64 are rotably coupled to the mounting bracket 59 by the rotatable shaft 58 so as to commonly rotate about a common axis provided by the shaft 58. The support shoe 65 is also attached to the mounting bracket 59. The mounting bracket 59, in turn, is slidably secured to the linear actuator 61, which is otherwise formed as part of the guide carriage 60. The cable 66 is wrapped about the pulley 64, and each end of the cable 66 is firmly fixed to respective ends of the support bar 40. With this configuration, when the linear actuator 61 is prompted to drive the mounting bracket 59, the cable 66 effects rotation of the rotary sheet cutter 63 and the pulley 64. In this regard, a circumference of the rotary sheet cutter 63 is preferably greater than that of the pulley 64. As a result, a resulting surface speed of the rotary sheet cutter 63 is greater than a linear speed of the mounting bracket 59. This configuration provides a cutting action without requiring a secondary drive for rotating the rotary sheet cutter 63. Additionally, this configuration provides several other advantages, including: requiring less space, providing a less expensive power source, providing more efficient cutting, etc., as compared to other available cutting devices such as a fixed blade or scissors cutting head. Alternatively, however, the sheet cutter assembly 26 can assume a wide variety of forms, including a driven straight blade, a scissors cutter, etc.

Figure 2:
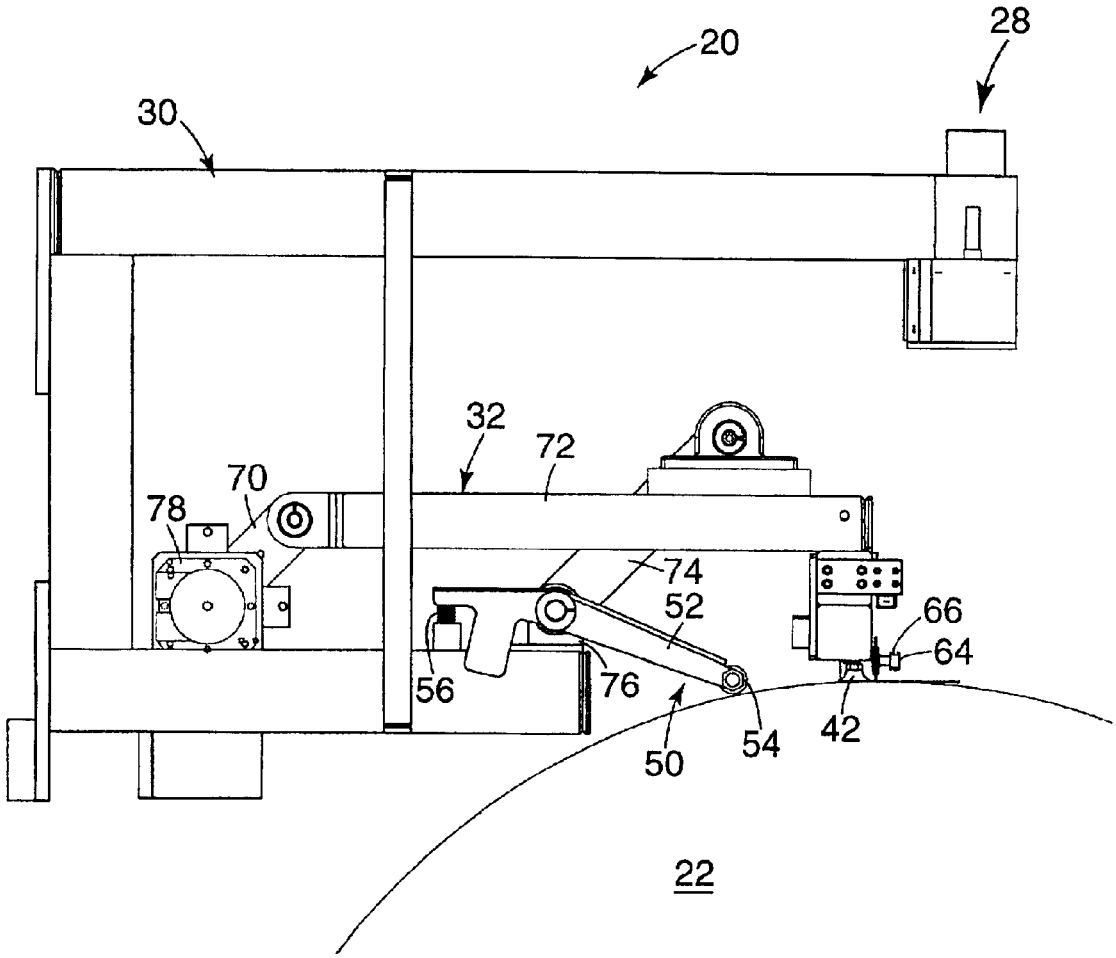
FIG. 2 is an enlarged side view of a portion of a sheet engagement mechanism and a sheet cutter of the applicator of FIGS. 1A and 1B.

By directly coupling the sheet cutter assembly 26 to the sheet engagement mechanism 24, and in particular coupling the guide carriage 60 directly to the support bar 40, the cutting surface provided by the blade mechanism 62 is constantly positioned at a known spatial location relative to the vacuum cups 42 (or other engagement device). This same preferred configuration provides the cutting surface of the blade mechanism 62 in highly close proximity to the vacuum cups 42. Further, the combination sheet engagement mechanism 24/cutter 26, and in particular the combination vacuum cups 42/cutting surface of the blade mechanism 62, are maneuverable as a singular unit. To this end, the linkage 32 preferably provides for desired movement of the combination sheet engagement mechanism 24/cutter 26. As best shown in FIG. 2, the linkage 32 is connected to the frame 30 (that otherwise maintains the taping device 28 as described below), and includes a first link 70, a second link 72, a third link 74, and a fourth link 76. This preferred four-bar linkage 32 eloquently transitions the sheet engagement mechanism 24/cutter 26 from the first, lowered position of FIG. 2 in which the vacuum cups 42 and the cutting surface of the blade mechanism 62 are radially aligned with the taping device 28, to a second, retracted position (not shown), in which the vacuum cups 42 and the blade mechanism 62 are moved upwardly and rearwardly relative to the taping device 28 (pursuant to the orientation of FIG. 2). To this end, an electromechanical activator 78, as known in the art, is preferably provided to dictate movement between the first and second positions. Though not shown, the activator 78 is preferably electrically connected to the programmable controller that prompts desired activation of the activator 78. Alternatively, the linkage 32 can assume forms other than that illustrated in FIG. 2, and may include more or less than four of the links 70-76. Regardless, the hold down device 50 is preferably connected to the frame 30 independent of the linkage 32, such that a position of the hold down device 50, and in particular the rollers 54 (or other contact device), can be maintained independent of a position/movement of the linkage 32.

Returning to FIGS. 1A and 1B, the taping device 28 preferably includes a track 90, a tape head 92, a tape cutter 94, a roll side sensor 96, and a press down roller 98. In general terms, the tape head 92, the tape cutter 94, the roll side sensor 96 and the press down roller 98 are all mounted to a plate 100 (or similar component) that is otherwise moveably secured to the track 90. The track 90, is mounted to the frame 30. The plate 100, and thus the components maintained thereby, is selectively traversed along the track as part of a taping operation. As a point of reference, FIGS. 1A and 1B illustrate the taping device 28 following a tape application operation (i.e., the plate 100 has traversed across the roll 22 so that the roll side sensor 96 is away from the roll 22). Prior to applying a splicing tape, the plate will be positioned at an opposite side of the track 90. The taping device 28 further preferably includes an actuator mechanism (not shown), such as a servomotor, that moves the plate 100 along the track 90. The actuator mechanism is electrically connected to the programmable controller (not shown) that otherwise dictates operation of the actuator mechanism.

Figure 3A:
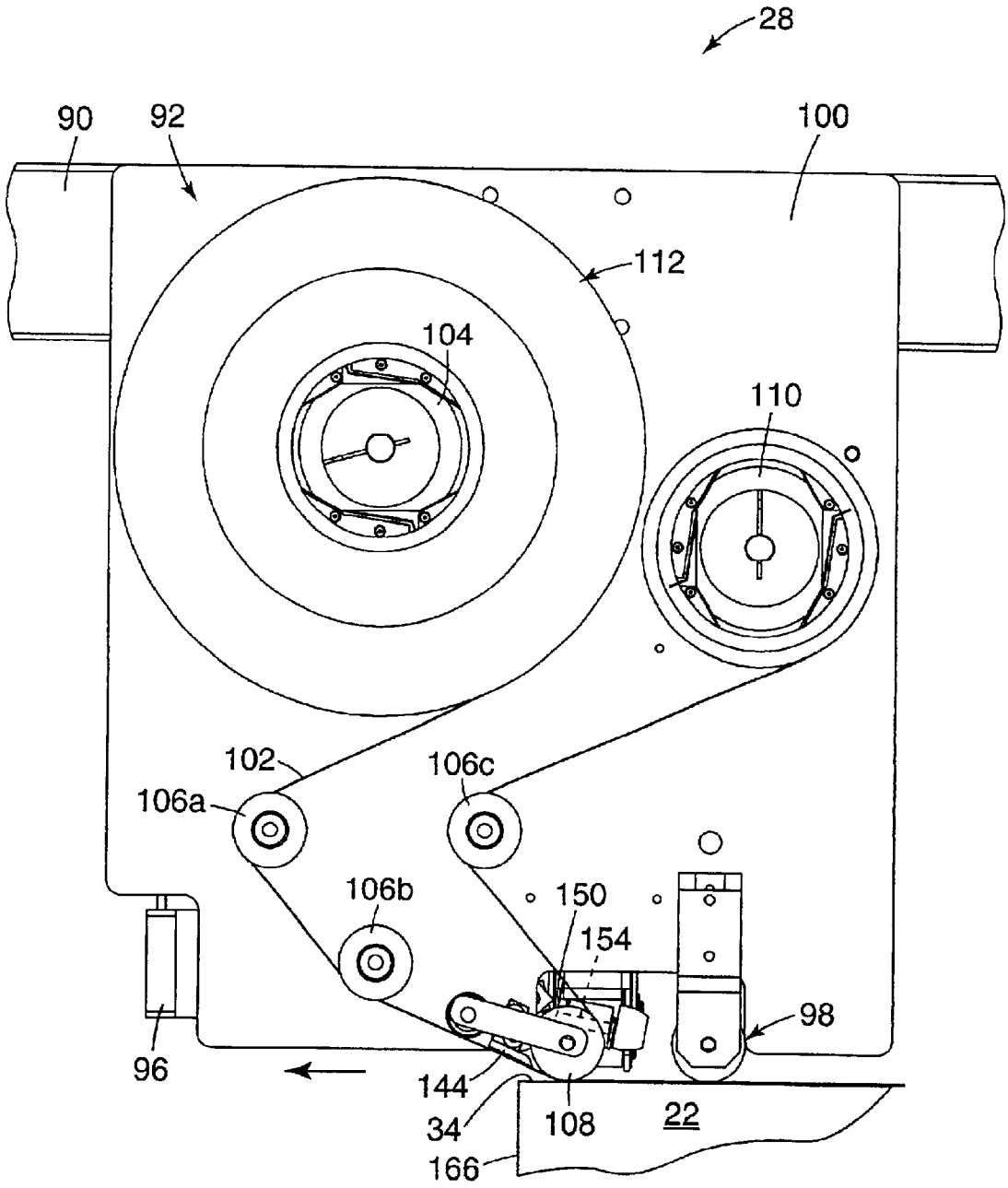
FIGS. 3A and 3B are enlarged rear views of a portion of a taping device of the applicator of FIGS. 1A and 1B in a taping and cutting position, respectively.
Figure 3B:
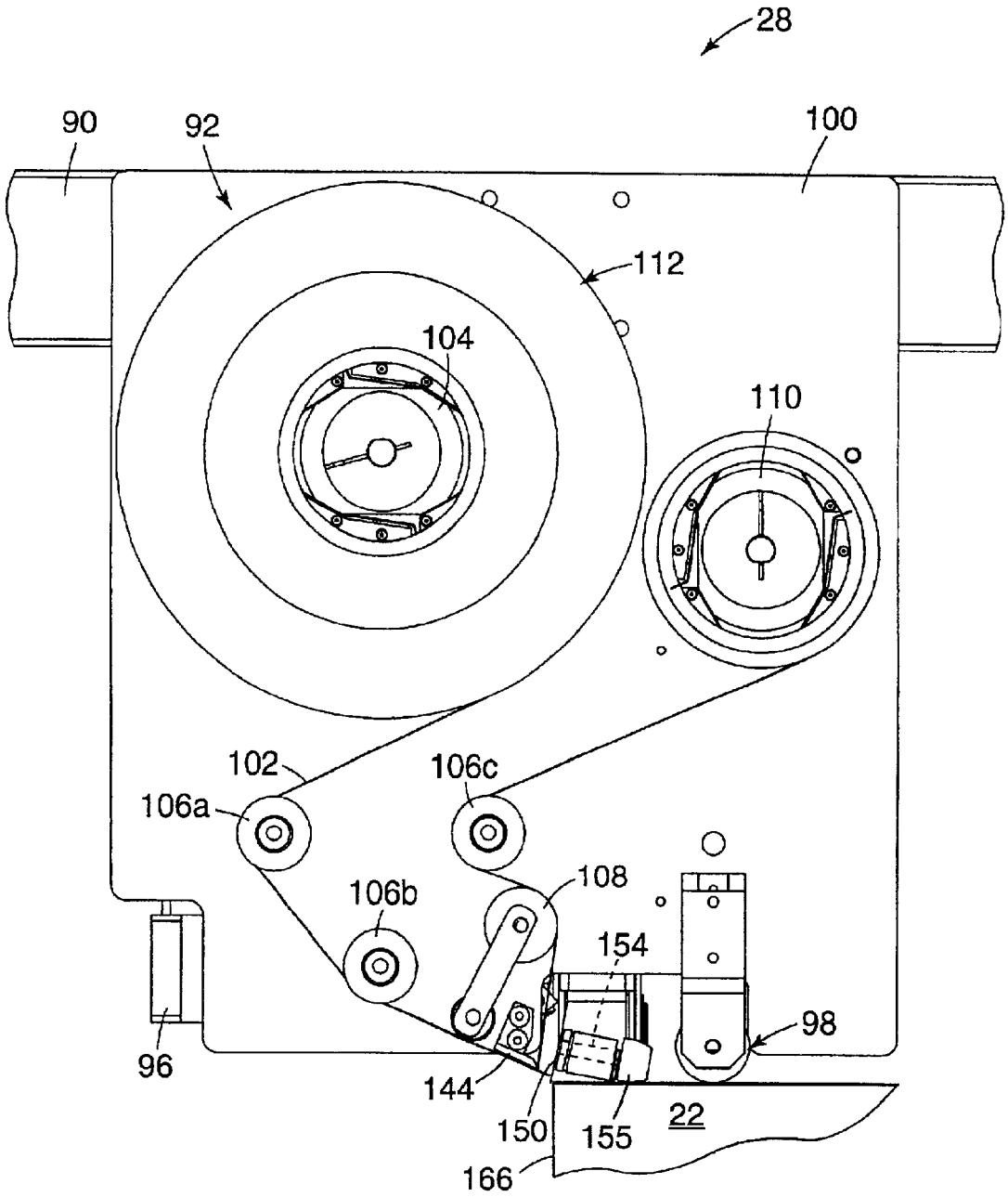

Portions of the taping device 28 are shown in greater detail in FIGS. 3A and 3B. As a point of reference, the taping device 28 is depicted in FIG. 3A as applying a splicing tape 102 to the outer-most layer 34 of the roll 22, with the tape head 92 (referenced generally) moving in a direction indicated by an arrow in FIG. 3A. Conversely, FIG. 3B illustrates the taping device 28 cutting a just applied segment of the splicing tape 102. With this in mind, the tape head 92 includes a supply reel 104, guide rollers 106*a*–106*c*, a placement roller 108, and a take-up reel 110. Notably, the term "take-up reel" refers to a device that winds up removed liner material. The rollers 106 and 108 and the reels 104 and 110 are coupled to the plate 100 as described below. The supply reel 104 maintains a roll 112 of the splicing tape 102. As shown in FIG. 3A, the splicing tape 102 extends from the supply reel 104 and along a tape path to the placement roller 108 via two of the guide rollers 106*a*, 106*b*. From the placement roller 108, the tape path continues to the third guide roller 106*c*, and finally to the take-up reel 110. In FIG. 3A, the placement roller 108 is in a lowered position, whereas FIG. 3B reflects the placement roller 108 in a raised position.

Figure 4:
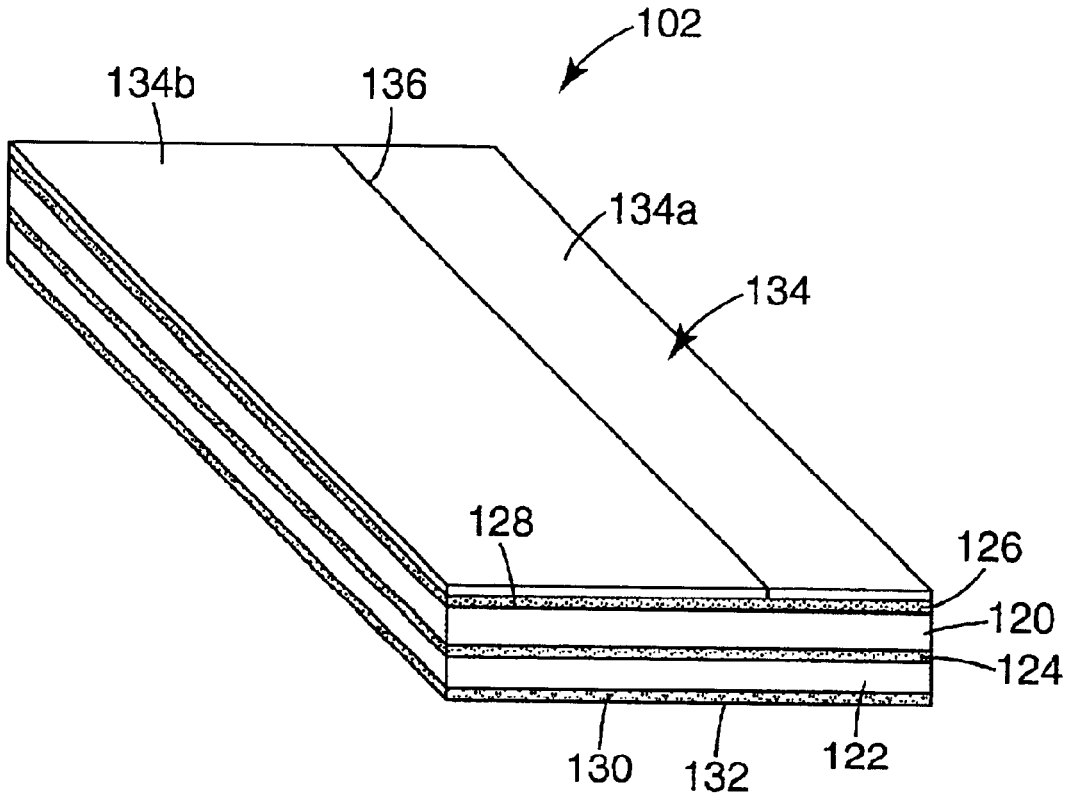
FIG. 4 is an enlarged, perspective view of one preferred separable splicing tape.

To best understand the preferred tape path and operation of the preferred tape head 92, reference is made to one preferred embodiment of the splicing tape 102 illustrated generally in FIG. 4. The one preferred splicing tape 102 generally includes a first or outer tape element 120 releasably secured to a second or inner tape element 122 by an intermediate separation layer 124. Further, an adhesive 126 is provided at an exterior surface 128 of the first tape element 120, whereas an adhesive 130 is provided at an exterior surface 132 of the second tape element 122. Finally, a release liner 134 is releasably secured over the adhesive 126 otherwise associated with the exterior surface 128 of the first tape element 120. Preferred examples of the splicing tape 102 are provided in U.S. application Ser. No. 09/770,985, filed Jan. 26, 2001, the teachings of which are incorporated herein by reference, although a variety of other configurations are also acceptable. Regardless, the release liner 134 is formed to include at least one split line 136 along which a first section 134*a* can be separated from a second section 134*b*. In particular, proper application of the splicing tape 102 to the roll 22 (FIG. 1A) requires removal of the first section 134*a*.

With additional reference to FIG. 3A, the take-up reel 110 serves as a liner removal device, facilitating removal of the first portion 134*a* of the release liner 134. When the tape roll 112 is initially loaded to the tape head 92, an excess strip of the first portion 134*a* of the release liner 134 is manually separated from a remainder of the splicing tape 102. The splicing tape 102 is then guided through the tape path, with only the separated first portion 134*a* of the release liner 134 extending from the placement roller 108, around the guide roller 106*c*, and to the take-up reel 110. The take-up reel 110 and the supply reel 104 are then rotated accordingly so that the point at which the first portion 134*a* of the release liner 134 initially separates from a remainder of the splicing tape 102 is position at approximately bottom dead center of the placement roller 108. When properly loaded, then, the splicing tape 102 can be precisely applied via the placement roller 108, with the take-up reel 110 continually removing the first portion 134*a* of the release liner 134. The take-up reel 110 maintains a tension in the splicing tape 102, in combination with the supply reel 104, via the first portion 134*a* of the release liner 134. Of course, where the splicing tape 102 assumes a form other than that illustrated in the one preferred embodiment, the tape head 92 can be configured accordingly.

An additional preferred feature of the tape head 92 is interrelated with the preferred tape cutter 94. As described in greater detail below, the tape cutter 94 is configured to cut the splicing tape 102 at a point that is substantially aligned with the side 166 of the roll 22. To properly perform this cutting operation, the placement roller 108 is preferably first translated away from the roll 22 and a blade provided by the tape cutter 94. Thus, in one preferred embodiment, the tape head 92 further includes an actuator mechanism 142 (shown generally in FIG. 1A) and a taping head shoe 144. The actuator mechanism 142 is electrically connected to the programmable controller (not shown) and dictates a position of the placement roller 108 based upon signals from the programmable controller. In particular, in the first, lowered position of FIG. 3A, the actuator mechanism 142 positions the placement roller 108 for applying the splicing tape 102 to the roll 22, as shown in FIG. 3A. Conversely, in the second, raised position (FIG. 3B), the actuator mechanism 142 maneuvers the placement roller 108 upwardly and away from the tape cutter 94. With this in mind, the actuator mechanism 142 can assume a variety of forms, and in one preferred embodiment includes a drive piston and a linkage assembly.

In the raised position, the taping head shoe 144 ensures that the splicing tape 102 is properly positioned to receive a cut. More particularly, the taping head shoe 144 directs the portion of the splicing tape 102 immediately upstream of the cut point (or the roll side 166) toward the roll 22 surface. Thus, in the raised position of FIG. 3B, the splicing tape 102 extends from guide roller 106*b* to the taping head shoe 144 and then to the placement roller 108. If the taping head shoe 144 were omitted, direct, overt extension of the splicing tape 102 from the guide roller 106*b* to the raised placement roller 108 (and thus away from the roll 22 surface) could cause the splicing tape 102 to disengage the roll 22, or otherwise cause cut imperfections.

As described above, the tape cutter 94 provides a blade for cutting the splicing tape 102. In one preferred embodiment, and with additional reference to FIG. 5, the tape cutter 94 includes a rotary tape blade or cutter 150 and an actuator mechanism 152 (best shown in FIG. 5). As a point of reference, the rotary cutter 150 is raised in FIG. 3A and lowered in FIG. 3B. The actuator mechanism 152 translates the rotary tape cutter 150 through a cutting motion transverse to a width of the splicing tape 102 (i.e., in a plane parallel to roll side 166 and perpendicular to the plane of FIGS. 3A and 3B). To this end, the actuator mechanism 152 is electrically connected to the programmable controller (not shown) that prompts activation thereof, and is connected to the rotary tape cutter 150 by a shaft 154 that is angularly oriented relative to a central axis defined by the actuator mechanism 152. With this preferred configuration, the rotary tape cutter 150 can more easily cut through the splicing tape 102. Further, a trailing roller 155 is preferably provided for supporting the rotary tape cutter 150 relative to the splicing tape 102.

The actuator mechanism 152 moves the rotary tape cutter 150 in a back-and-forth motion during a cutting operation. Further, and with specific reference to FIG. 5, the actuator mechanism 152 preferably provides for a camming action, via links 156, to move the rotary tape cutter 150 up and away from the placement roller 108 during a tape application operation. This raised position of the rotary tape cutter 150 is shown in phantom in FIG. 5. Alternatively, other configurations for the tape cutter 94 are also acceptable.

Returning to FIGS. 3A and 3B, the roll side sensor 96 is provided to sense the location of sides 160 (FIG. 1A) and 166 of the roll 22. Thus, the roll side sensor 96 can assume a variety of forms known in the art, such as a mechanical, optical, or proximity sensor, and is preferably electrically connected to the programmable controller (not shown). Regardless, the roll side sensor 96 is located along the plate 100 at a precise, known distance from the placement roller 108 and the rotary tape cutter 150. Thus, based upon a signal from the roll side sensor 96 indicating that a side of the roll 22 has been reached (such as the side 160 or 166), the programmable controller can initiate desired operation of the tape head 92 and/or the tape cutter 94. Operation of the tape head 92 and the tape cutter 94 based upon signal(s) from the roll side sensor 96 are described in greater detail below.

Finally, the press down roller 98 extends downwardly from the plate 100 to a plane corresponding with a plane defined by the placement roller during a tape application operation. In a preferred embodiment, the press down roller 98 is spring loaded, so as to apply a downward force (relative to the orientation of FIGS. 3A and 3B) on to a contacted surface, such as a material being adhered to the splicing tape 102.

Returning to FIGS. 1A and 1B, the above-described taping device 28 is secured to the frame 30 via the track 90. The frame 30, in turn, is moveably mounted within a guide station (not shown) that likely includes other frame components, for example a spindle for maintaining the roll 22. With this configuration, the frame 30, and thus the mounted sheet engagement mechanism 24, the sheet cutter assembly 26, and the taping device 28, are at known spatial positions relative to the roll 22. Further, the linkage 32 allows the sheet engagement mechanism 24 and the sheet cutter assembly 26 to move independent of the taping device 28. That is to say, the taping device 28, and in particular the tape head 92, can be maintained in a singular plane during movement of the sheet engagement mechanism 24 and the sheet cutter assembly 26. Notably, relevant portions of the sheet engagement mechanism 24, the sheet cutter assembly 26, and the taping device 28 are spatially positioned at known locations relative to one another, thereby facilitating precise splicing tape application.

Operation of the splicing tape applicator 20 is shown in FIGS. 6A–10B. For ease of illustration, portions of FIGS. 6A–10B are illustrated in block form and/or diagrammatically. Beginning with FIGS. 6A and 6B, the roll 22 has been loaded relative to the applicator 20, and splicing tape 102 (FIG. 3A) has been loaded into the tape head 92. In particular, the roll 22 is positioned such that the free end 36 of the outer-most layer 34 is upstream of the vacuum cups 42. Further, the frame 30 (FIG. 1A) has been lowered, or otherwise moved toward the roll 22 such that the vacuum cups 42 have engaged the outer-most layer 34. To this end, the roll sensor 44 initially contacts the outer-most layer 34, signaling the programmable controller (not shown) to initiate a vacuum at the vacuum cups 42 via the vacuum source (not shown). As best shown in FIG. 6B, in this initial roll engagement state, the rotary sheet cutter 63 and the tape head 92 are positioned away from the first side 160 of the roll 22. As such, the vacuum cups 42 are not impeded from contacting the outer-most layer 34.

Figure 7A:
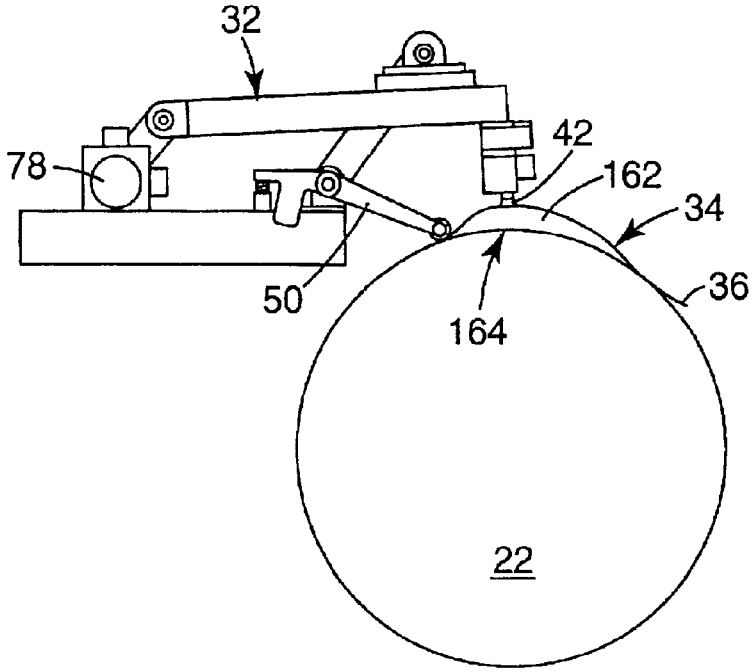
Figure 7B:
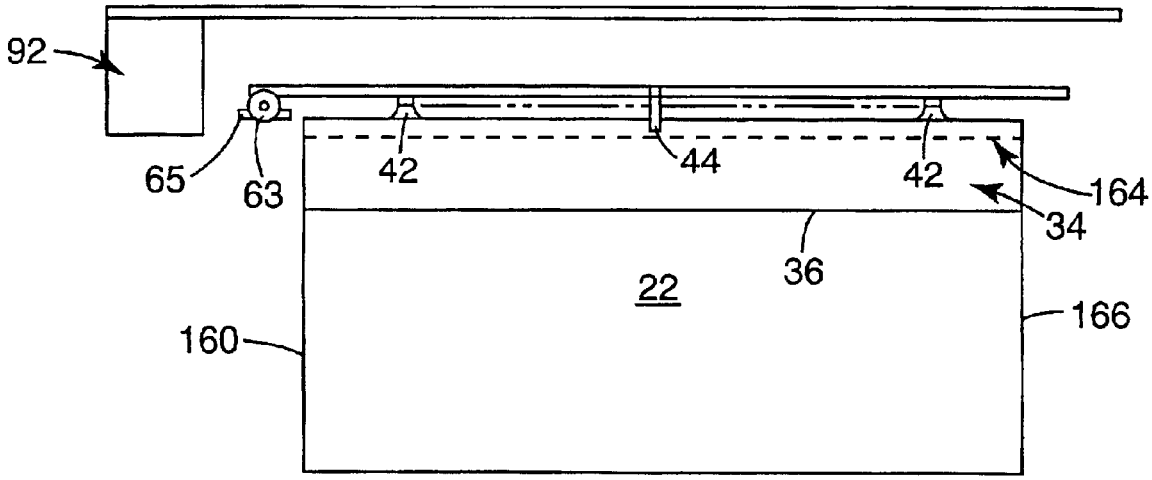

Once the vacuum cups 42 have properly engaged the outer-most layer 34, the linkage 32 moves the vacuum cups 42, and thus contacted region of the outer-most layer 34, away from a remainder of the roll 22 as shown in FIGS. 7A and 7B. For example, the programmable controller (not shown) prompts the activator 78 to move the linkage 32 as shown. This action generates a spacing 162 between the contacted region of the outer-most layer 34 and a remaining wound portion 164 of the roll 22. In other words, at least a portion of the outermost layer 34 is unwound from the roll 22, with the hold down device 50 preferably preventing the outer-most layer 34 from overtly unwinding downstream of the point of engagement between the vacuum cups 42 and the outer-most layer 34. The spacing 162 corresponds with an extension of the rotary sheet cutter 63 beyond an engagement plane defined by the vacuum cups 42, and is preferably on the order of approximately 0.25 inch (0.64 cm). Regardless, the spacing 162 is sufficient to allow the rotary sheet cutter 63 to cut the outer-most layer 34 adjacent the vacuum cups 42 without undesirably cutting the remaining wound portion 164.

Figure 8:
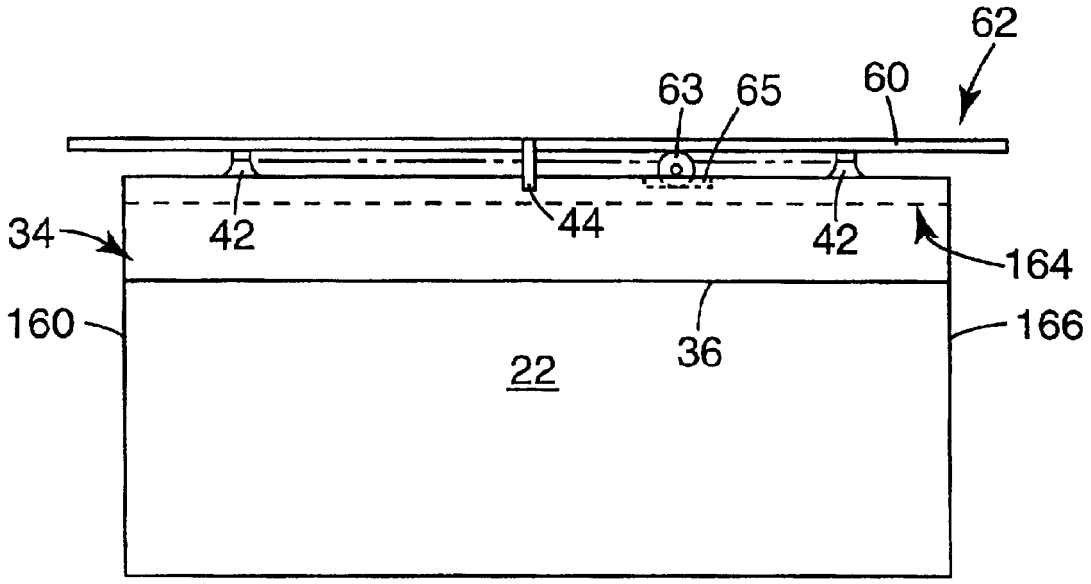

The blade mechanism 62 is then operated to cut the outer-most layer 34, as shown in FIG. 8. The blade mechanism 62 is prompted to traverse the guide carriage 60 via a signal from the programmable controller (not shown), thereby cutting the outer-most layer 34. With the one preferred embodiment of the blade mechanism 62, the support shoe 65 slides into the spacing 162 (FIG. 7A), and thus is beneath and supports the outer-most layer 34 as the rotary sheet cutter 63 cuts the sheet material. The support shoe 65 assists in positioning the outer-most layer 34 relative to the rotary sheet cutter 63 for a more efficient cutting operation.

Figure 9A:
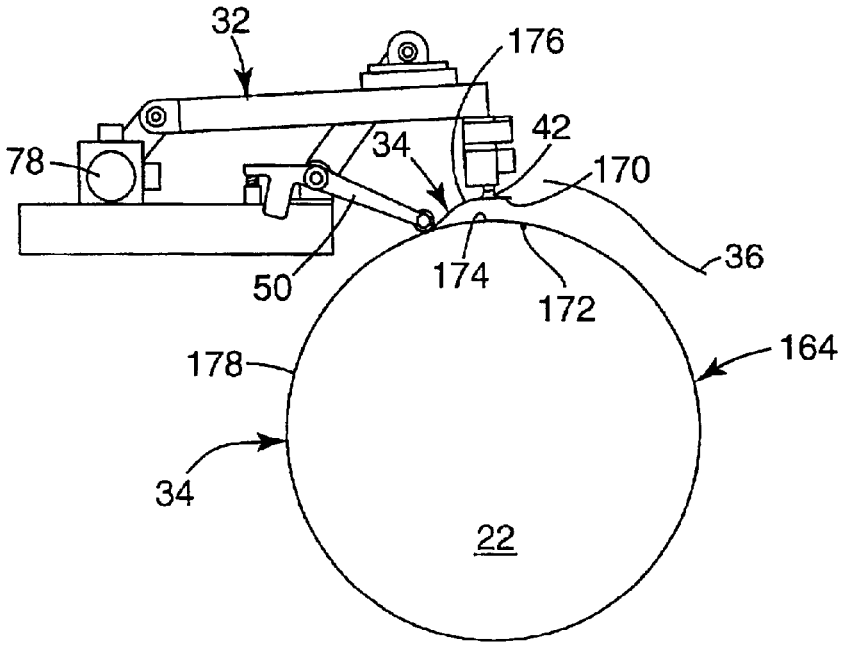
Figure 9B:
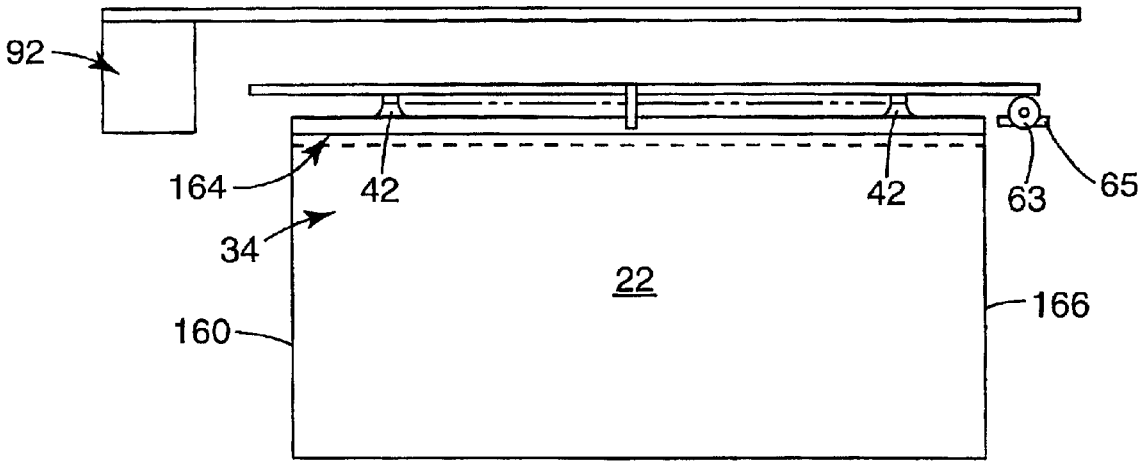

FIGS. 9A and 9B illustrate the applicator 20 and the roll 22 following the cutting operation. In particular, the cut forms a "new" leading edge 170 for the outer-most layer 34, with excess sheet material upstream of the cut (or leading edge 170) falling away from the roll 22. Downstream of the leading edge 170, however, a portion the outer-most layer 34 remains secured to the vacuum cups 42, and spaced from the remaining wound portion 164 of the roll 22. Because a spatial location of the wheel blade of rotary sheet cutter 63 relative to spatial location of the vacuum cups 42 and the tape head 92 is known (via the frame 30 and the linkage 32), the spatial location of the formed leading edge 170 relative to these components is also known. Based upon this spatial correlation, a tape application line 172 along a circumference of the remaining wound portion 164 of the roll 22 can also be determined. As a point of reference, the tape application line 172 is the line at which the leading edge 170 would be positioned were the outer-most layer 34 completely rewound to the roll 22. Stated otherwise, the tape application line 172 represents the point at which the roll 22 transitions from the outer-most layer 34 to a second outer-most layer 174 where the outer-most layer 34 is rewound to the roll 22. In the spaced position of FIGS. 9A and 9B, however, the outer-most layer 34, including the leading edge 170 is unwound, whereas a trailing section 178 of the outer-most layer 36 remains wound to the roll 22. It is for this reason that the tape application line 172 is referred to as being "imaginary".

With the above definitions in mind, the tape application line 172 extends across the axial width of the roll 22, and is definable on the circumference of the remaining wound portion 164. Because the tape application line 172 represents the point at which the leading edge 170 will reside upon subsequent rewinding, defining its location in advance of applying the splicing tape (not shown) is highly important, as the splicing tape is optimally positioned along the tape application line 172 for receiving the leading edge 170. Thus, by forming the leading edge 170 at a known spatial position relative to the tape head 92 (FIG. 1A), more preferably by radially aligning the rotary sheet cutter 63 relative to the placement roller 108 (FIG. 3A), the tape head 92 is properly positioned to operate along the tape application line 172.

Figure 10A:
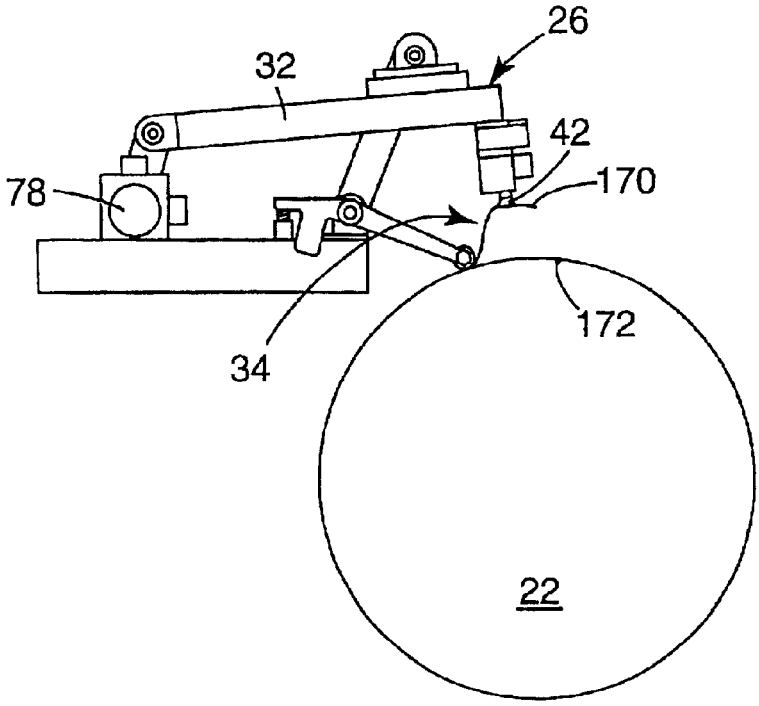
Figure 10B:
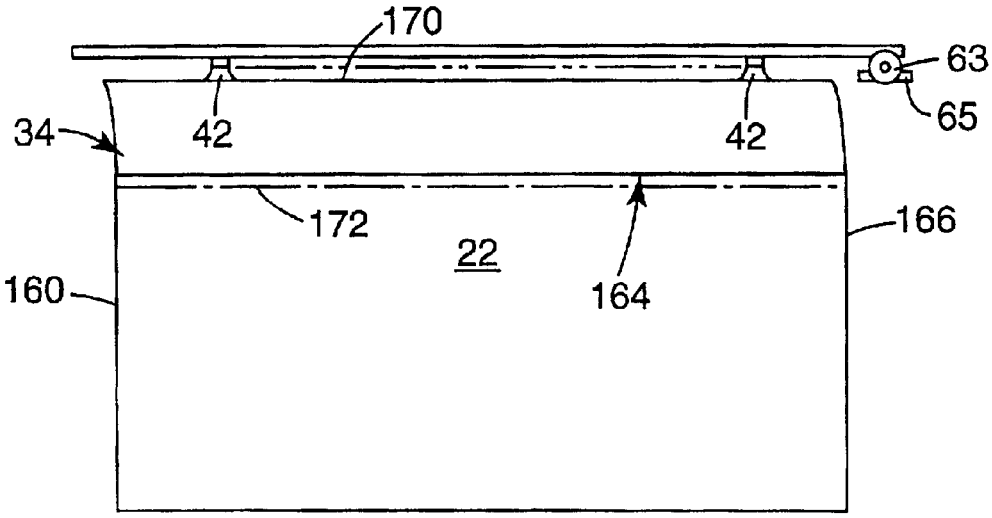

Prior to applying the splicing tape (not shown), the sheet cutter assembly 26 and the leading edge 170 of the outer-most layer 34 are preferably further moved away from the roll 22, and in particular the defined tape application line 172, as shown in FIGS. 10A and 10B. In particular, the linkage 32 is translated to a fully raised position, for example via the activator 78, to move the sheet cutter assembly 26 and the vacuum cups 42 (and thus the leading edge 170) up and away from the tape application line 172.

Figure 11A:
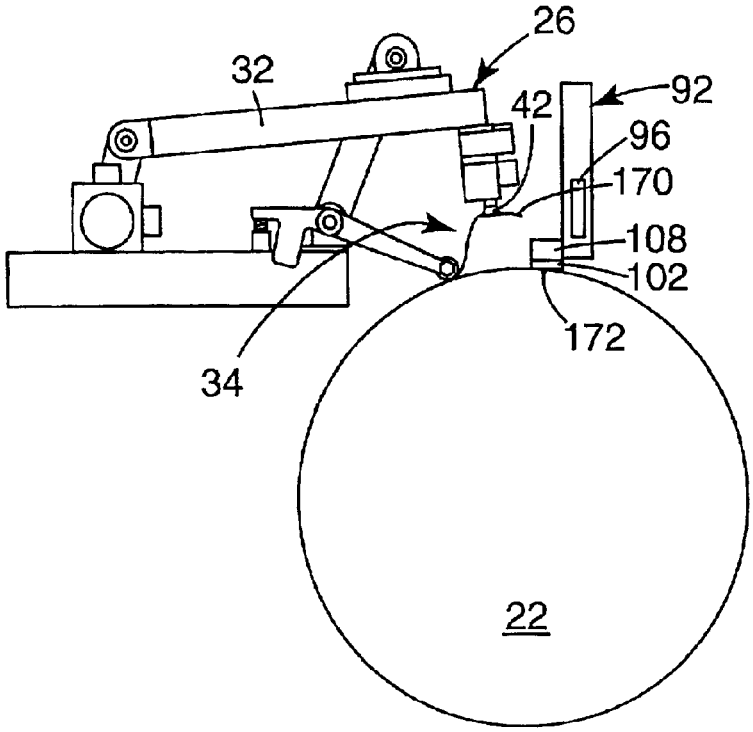
Figure 11B:
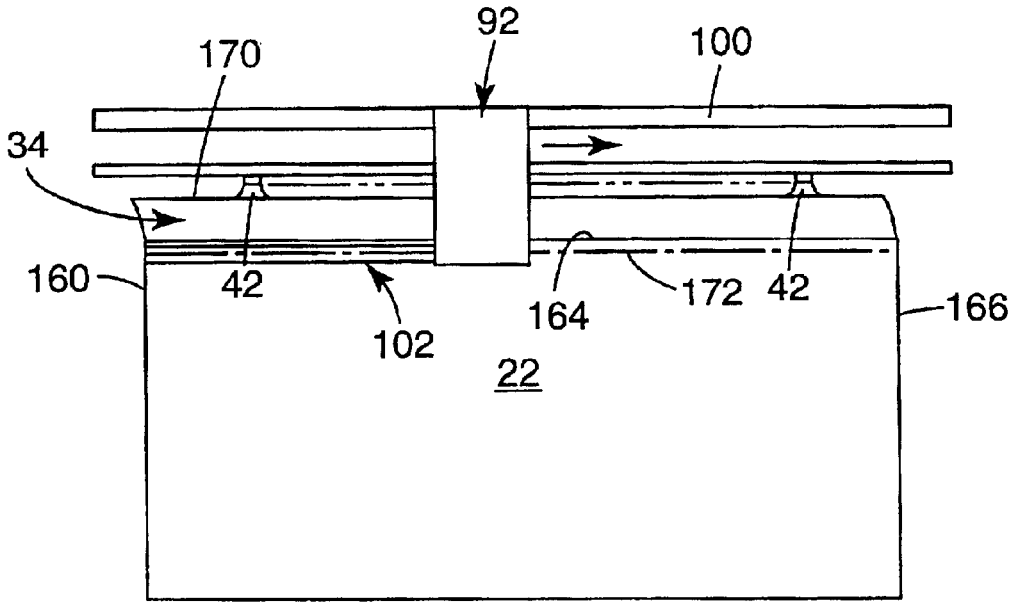

With the linkage 32 in the fully raised position, the taping device 28 is then operated to apply the splicing tape 102 across the wound portion 164 of the roll 22, preferably along the tape application line 172. As shown in FIGS. 11A and 11B, the tape head 92 is guided, via the track 100, across a width of the roll 22, applying the splicing tape 102 as previously described. In this regard, as the tape head 92 is initially moved toward the first side 160 of the roll 22, the roll side sensor 96 senses a position of the first side 160. Based upon a known distance between the sensor 96 and the placement roller 108, the programmable controller (not shown) is able to prompt initial application of the splicing tape 102 in close proximity to the first side 160, within approximately 0.25 inch (0.64 cm). It is noted that no other available automated splicing tape applicator provides for this level of precision.

The tape head 92 continues across a width of the roll 22, applying the splicing tape 102 and preferably removing the first section 134*a* (FIG. 4) of the release liner 134 (FIG. 4) as previously described. Toward the end of the taping path, the roll side sensor 96 senses the presence of the second side 166 of the roll 22. Upon receiving this signal, the programmable controller (not shown) initiates a tape cutting operation. First, based upon a known distance between the placement roller 108 (or the point at which the splicing tape 102 is dispensed from the tape head 92) and the roll side sensor 96, the controller directs the tape head 92 to continue dispensing the splicing tape 102 to a point just beyond the detected second side 166. The placement roller 108 is then moved to a raised position as previously described with respect to FIG. 3B, and the rotary tape cutter 150 (FIG. 3B) moved into contact with the applied splicing tape 102 at a point substantially aligned with the second side 166. Finally, the rotary tape cutter 150 is translated across a width of the splicing tape 102, severing the splicing tape 102. In one preferred embodiment, the rotary tape cutter 150 is passed over the splicing tape 102 twice to ensure a complete cut. Finally, the rotary tape cutter 150 is returned to a raised position.

Figure 12A:
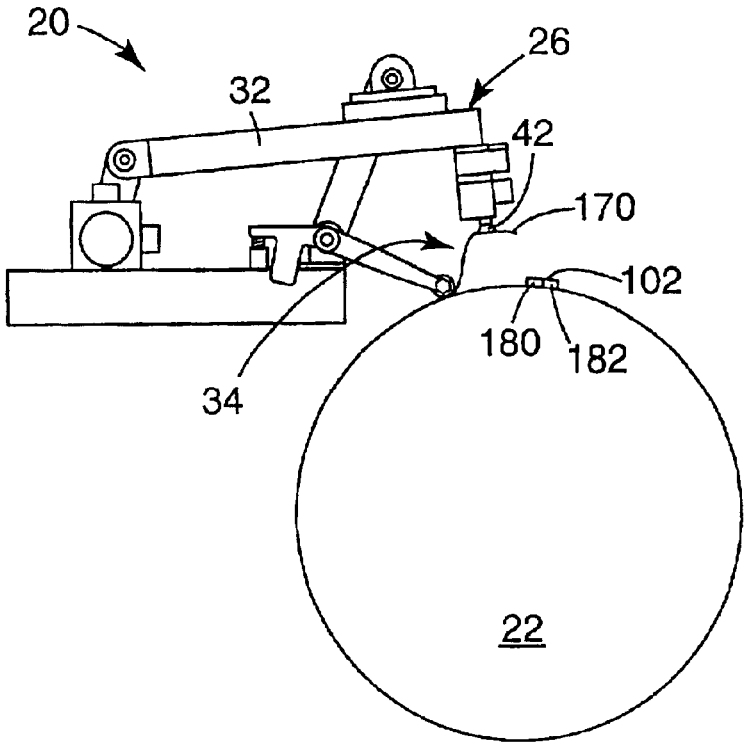
Figure 12B:
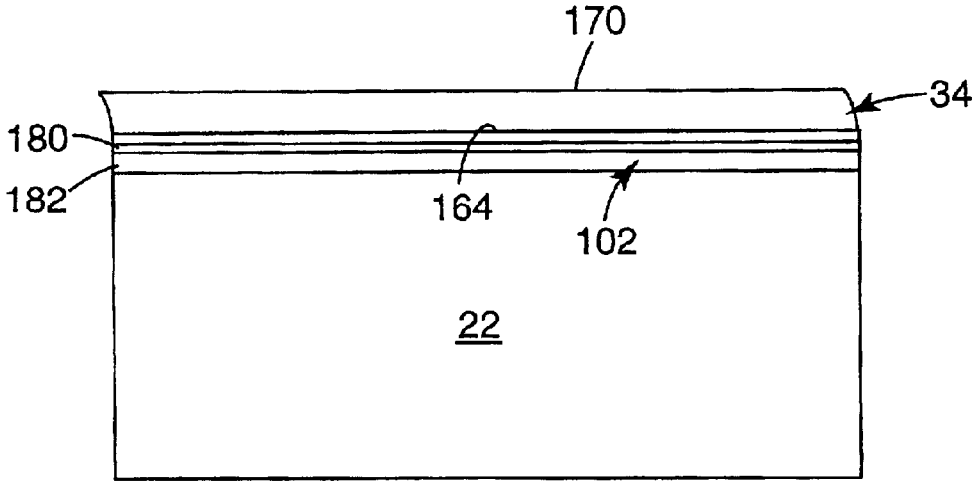

As shown in FIGS. 12A and 12B, following the tape application operation, the splicing tape 102 preferably extends straight across an entire width of the roll 22, parallel with an axis defined by the roll 22. Alternatively, the applicator 20 can be operated such that the splicing tape 102 extends across only a portion of the roll width and/or is intermittently applied. Even further, the splicing tape 102 can be applied at an angle relative to the roll axis. Regardless, with the most preferred form of the splicing tape 102 previously described, following application and cutting, an outer surface of the splicing tape 102 is defined by a first section 180 with exposed adhesive and a second section 182 that preferably has the release liner 134 (FIG. 4) retained thereon.

Figure 13A:
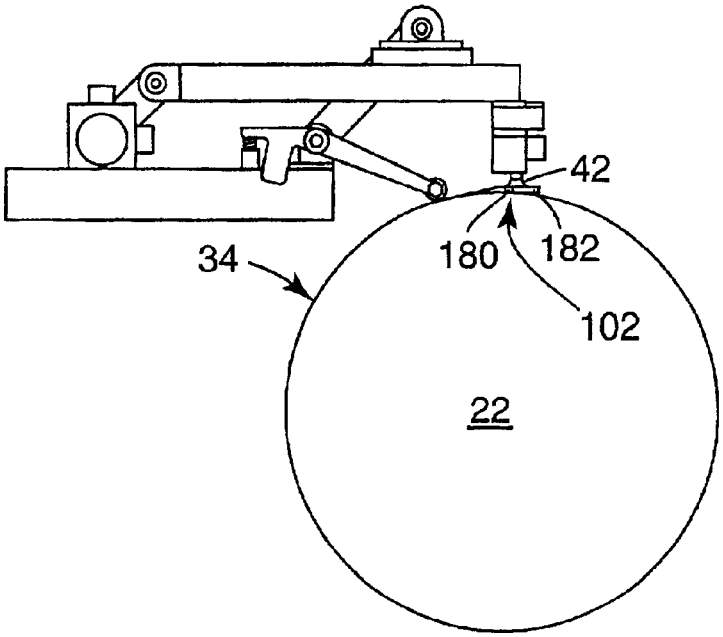
Figure 13B:
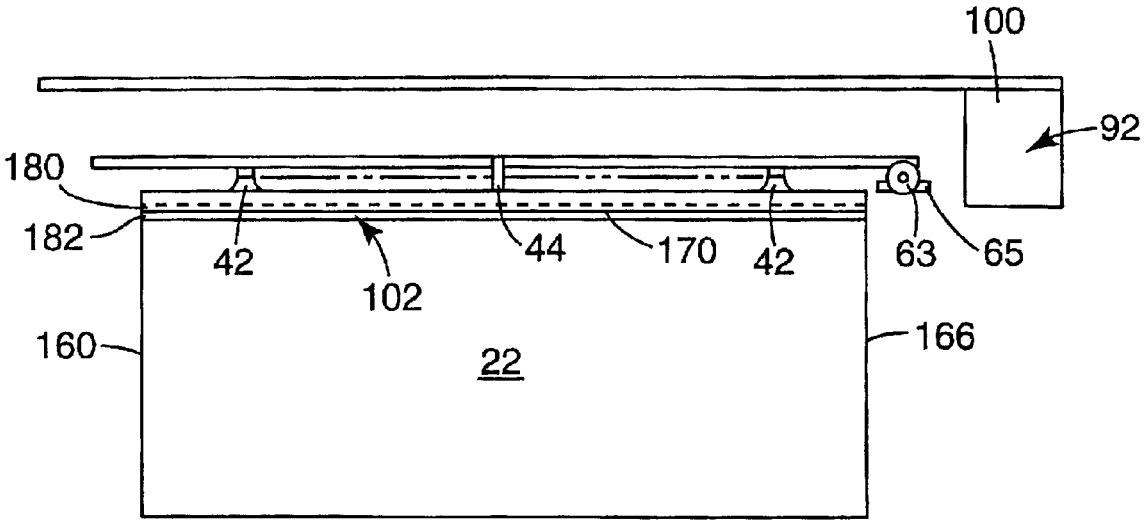

The plate 100, and thus the components maintained thereby, is further moved away from the second side 166 of the roll 22, and the outer-most layer 34 re-wound to the roll 22 as shown in FIGS. 13A and 13B. More particularly, the linkage 32 is operated to direct the leading edge 170 into contact with the splicing tape 102, at the first section 180, to adhere the leading edge 170 to the splicing tape 102 via the adhesive otherwise provided on the first section 180. The vacuum cups 42 are then released from the outer-most layer 34, and the linkage 32 moved back to the raised position as previously described. Finally, the plate 100 is traversed back across the roll 22, with the press down roller 98 (FIG. 3A) pressing against the leading edge 170. This action ensures that the leading edge 170 adheres to the splicing tape 102.

Upon completion of applicator 20 operation, the splicing tape 102 is applied to the roll 22, with the leading edge 170 of the outer-most layer 34 being adhered thereto. In the most preferred embodiment and as shown in FIG. 13B, the leading edge 170 is positioned such that the outer-most layer 34 covers a portion of the width of the splicing tape 102, whereas the remaining width is exposed. Other locations of the leading edge 170 relative to the splicing tape 102 can also be achieved by the applicator 20. In general terms, however, the applicator 20 can automatically place the splicing tape 102 on the roll 22 and subsequently position the leading edge 170 over at least a portion of the splicing tape 102, within plus or minus 5 mm, preferably within plus or minus 1 mm, of a desired orientation on a consistent basis. Once again, this heretofore-unavailable result is achieved by cutting the leading edge 170 of the outer-most layer 34 at a spatial location that is directly aligned with a line or plane along which the splicing tape 102 is subsequently applied to the roll 22. Effectively, then, the applicator 20 establishes the known tape application line 172 (FIG. 11B) relative to the roll 22 by aligning the sheet cutting blade 63 with the placement roller 108.

Figure 14:
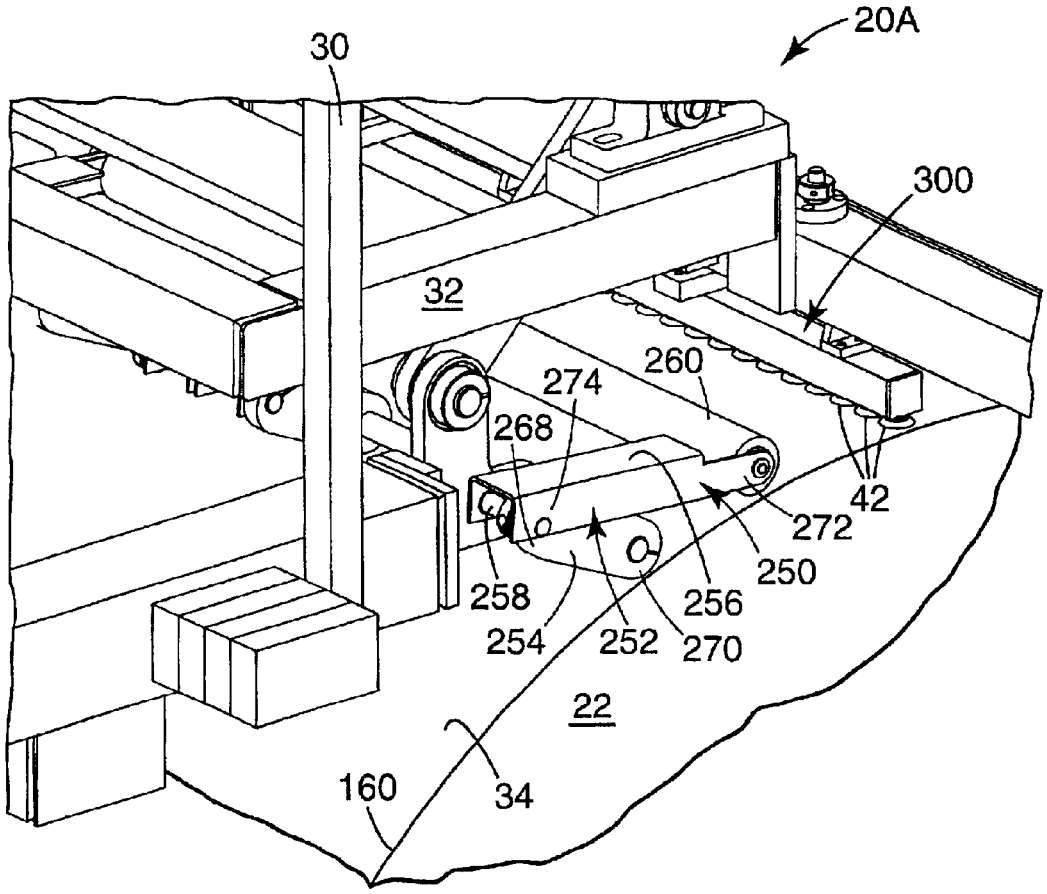
FIG. 14 illustrates a side perspective view of an alternative splicing tape applicator, including a paper applicator, in accordance with the present invention positioned over a roll of sheet material.

FIG. 14 illustrates a portion of an alternative splicing tape applicator 20A. In one preferred embodiment, splicing tape applicator 20A is generally similar to the splicing tape applicator 20 as described above and operates in a similar manner, with the addition of the paper applicator 250 and the alternative sheet engagement mechanism 300.

Figure 15A:
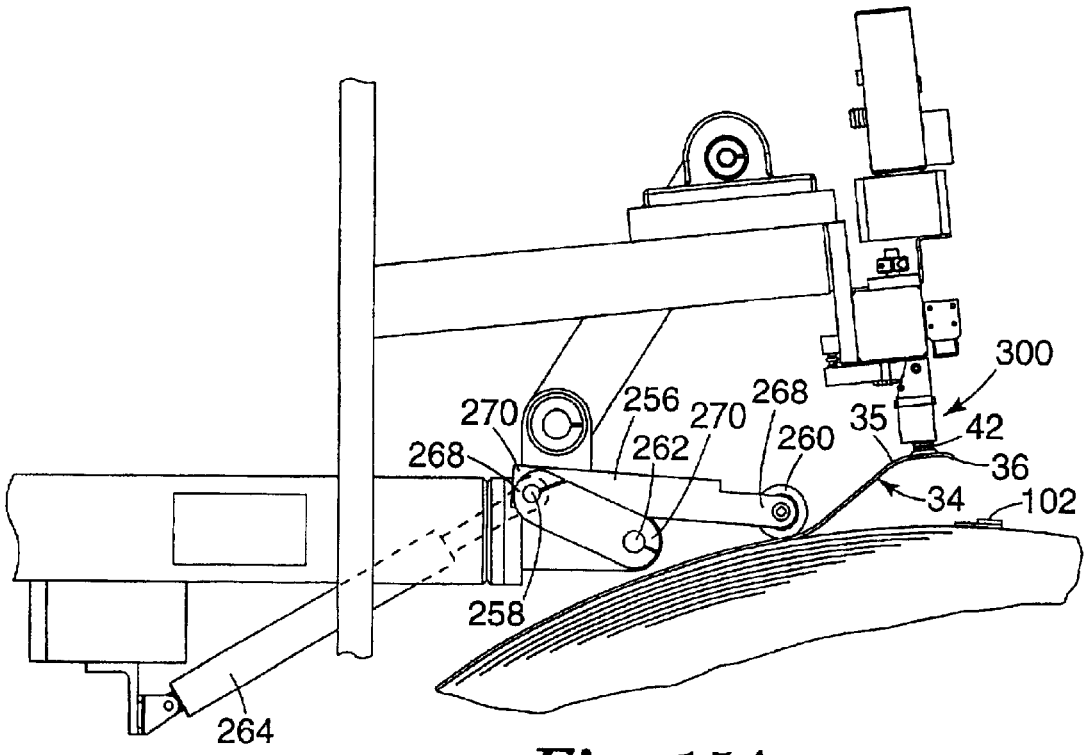
FIG. 15A–15C illustrate a portion of the operation of the splicing tape applicator of FIG. 14.
Figure 15B:
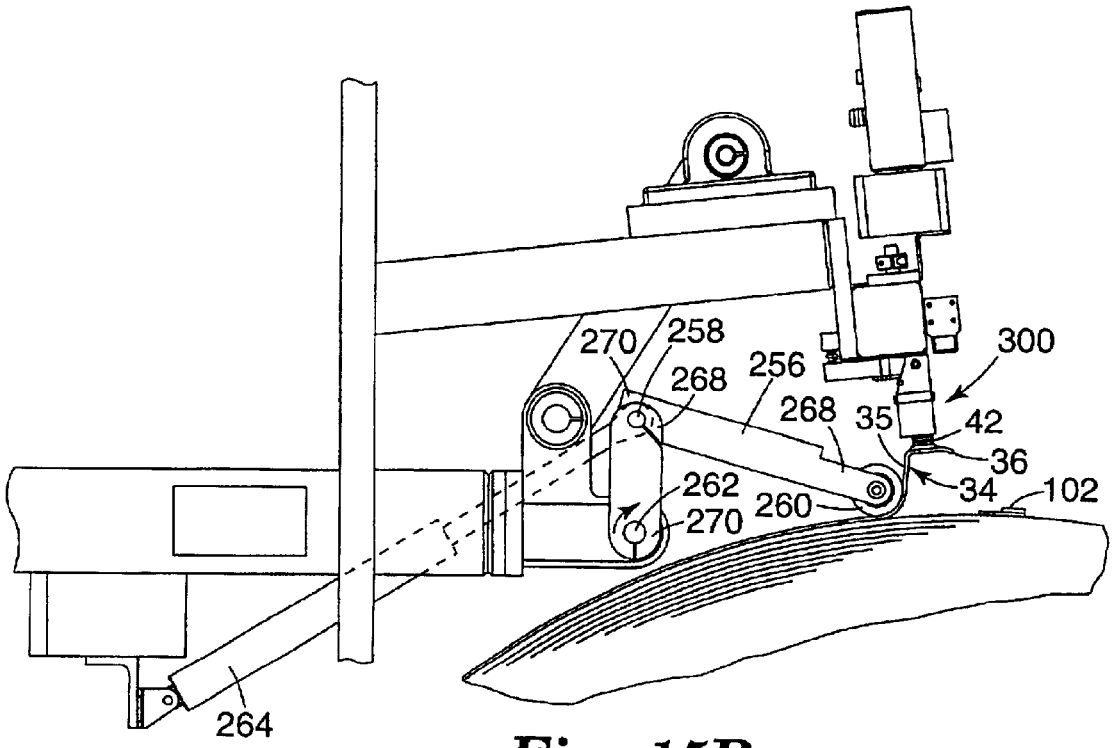
Figure 15C:
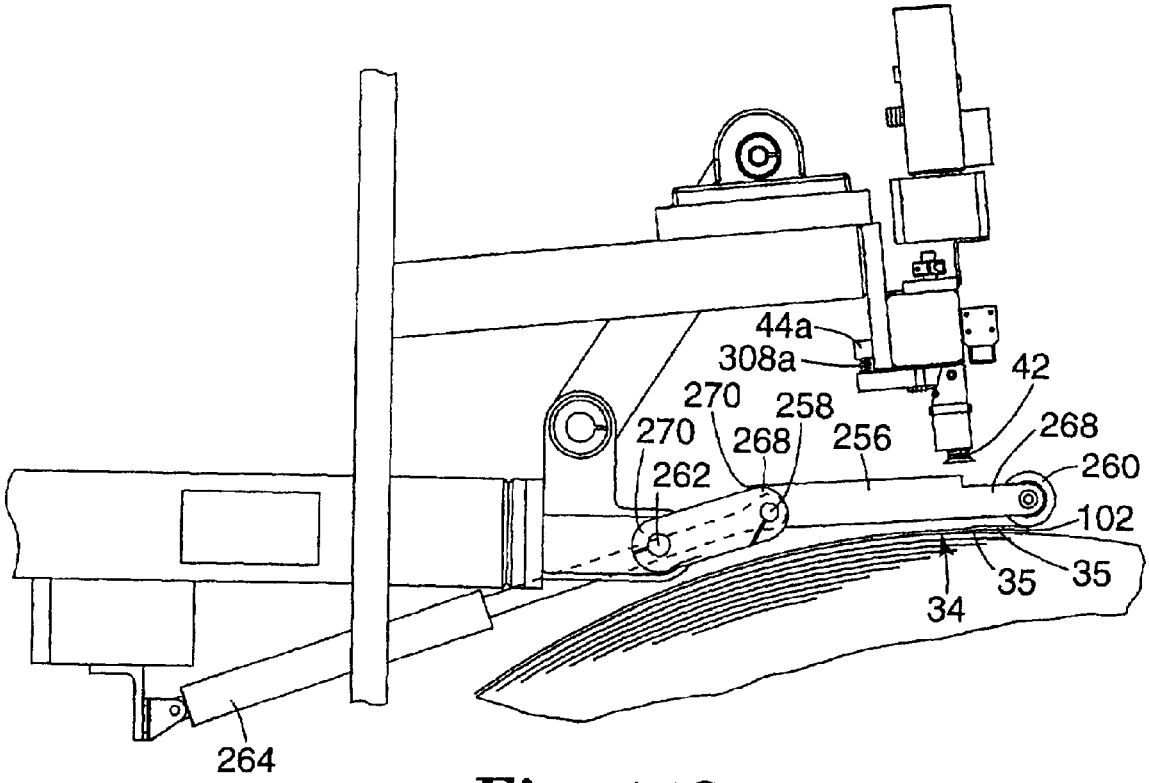

The paper applicator 250 preferably includes an arm 252 with a roller 260 mounted on the end of the arm 252. In this embodiment of the arm 252, the arm includes a first arm segment 254 and a second arm segment 256. The first arm segment 254 includes a first end 268 and a second end 270 opposite the first end 268. The second arm segment 256 includes a first end 272 and a second end 274 opposite the first end 272. The first arm segment 254 and second arm segment 256 are connected by a shaft 258. More specifically, the shaft 258 connects the first end 268 of the first arm segment 254 with the second end 270 of the second arm segment 256. The shaft 258 is used to help actuate the paper applicator 250 back and forth over the roll 22, as illustrated in FIGS. 15A–15C.

The paper applicator 250 is used to perform at least four functions. All four operations are illustrated in FIGS. 15A–15C. First, the paper applicator 250 functions as a hold down device for the sheet of material as the outer-most layer 34 of sheet material on the roll 22 is being raised by the sheet engagement mechanism 300. This function is illustrated in FIG. 15A. As illustrated, the paper applicator 250 serves to prevent excess displacement of the outer-most layer 34 of the roll 22 as the sheet engagement mechanism 300 is lifting the outer-most layer 34 away from the remainder of the roll 22. As the sheet engagement mechanism 300 lifts the outer-most layer 34, a lifted portion 35 of the outer-most layer 34 is formed between the paper applicator 250 and the forward edge of the outer-most layer, while the paper applicator 250 holds the remaining portion of the outer-most layer 34 against the roll 22. As explained above, the outer-most layer is raised to allow the splicing tape to be applied.

The second function of the paper application 250 is to progressively apply pressure to the lifted portion 35 of the outer-most layer 34 of the sheet material on the roll 22 to cause the lifted portion 35 of the outer-most layer 34 to progressively contact the remainder of the roll 22 and to the splicing tape that has been applied while the outer-most layer was in the raised position. This function is illustrated in FIG. 15B. An actuator 264 is attached to the shaft 258. Preferably, the actuator 264 is a pneumatic air cylinder. As the air cylinder 264 extends progressively, the shaft 258 moves in the same direction. The shaft 258 actuates the arm 252 forward along roll 22. As the arm 252 is moved forward, the roller 260 progressively flattens the outer-most layer 34 against the remainder of the roll 22. Preferably, the roller 260 includes one-way clutch and a friction clutch, which causes the roller to turn under tension in a clockwise direction, and causes the roller 260 to roll freely in the counterclockwise direction, as viewed from the first side 160 of the roll 22. With this configuration, as the roller rolls in a clockwise direction, the roller applies a force to the outer-most layer 34 to tightly wrap the outer-most layer around the remainder of the roll, as the roll progressively rolls along the lifted portion. Also, with this configuration, when the roller rolls in a counterclockwise direction, it avoids loosening the outer-most layer 34 from the roll 22, as the paper applicator 250 is retracted. Because the roller 260 rolls under tension as it progressively rolls against the outer-most layer 34, as the paper applicator 250 is actuated forward, the outer-most layer 34 is wrapped under tension around the remainder of the roll 22. By wrapping the outer-most layer 34 under tension around the remainder of the roll 22, wrinkles in the outer-most layer 34 may be avoided and air trapped between the outer-most layer 34 and the remainder of the roll 22 may be reduced. These wrinkles and entrapped air may be particularly difficult to remove when the outermost layer is bonded to the splicing tape. If the outer-most layer 34 is tightly wrapped around the rest of the roll 22 and taped into place by the splicing tape, then the outer-most layer 34 is less likely to become disengaged from the rest of the roll 22, when the roll 22 is later rotated at a high speed for attachment to another roll of sheet material using the splicing tape, as described in the Background Section.

The third function of the paper applicator 250 is to disengage the outer-most layer 34 of the sheet material from the sheet engagement mechanism. As the roller 260 of the paper applicator 250 holds down the outer-most layer 34 at a distance remote from the leading edge 36 of the outer-most layer 34, the vacuum source to the vacuum cups 42 is operating to hold the outer-most layer 34 above the remainder of the roll 22. As the paper applicator 250 progressively moves the roller 260 along the lifted portion 225 of the outer-most layer towards the leading end 36, the vacuum source continues to operate. Once the roller 260 is almost below the vacuum cups 42, the outer-most layer 34 is then pulled or disengaged by the roller 260 from the vacuum cups 42 to allow the roller 260 to continue progressively rolling against the outer-most layer 34. It is preferable the vacuum source continue operating until after the outer-most layer 34 has completely disengaged from the sheet engagement mechanism 300, to allow the paper applicator 250 to continue to wrap the outer-most layer 34 under tension against the remainder of the roll 22. With this approach, premature contact of the outer-most layer to the adhesive portion of the splicing tape may be avoided, which helps prevents wrinkling .

The fourth function of the paper applicator 250 is to apply the outer-most layer 34 to the splicing tape 102. This function is illustrated in FIG. 15C. As the paper applicator 250 continues to progressively roll along the outer-most layer 34 under tension, the paper applicator adheres the leading end 36 of the outer-most layer 34 to the first adhesive section of the tape 102. The second section of the splicing tape remains exposed adjacent the leading end 36 of the outer-most layer 34. At this time, the outer-most layer 34 is tightly wound under tension around the remaining roll 22 and held in position by the splicing tape 102.

Preferably, the paper applicator 250 performs each of these four functions. However, in some applications, it may be preferred that the applicator 250 apply one or any combination of the four functions. Also, the applicator may be used with or without the cutters described herein. The applicator is well-suited for use with any mechanism that lifts the leading edge portion of the web away from the remainder of the roll to allow a splicing tape to be applied. The applicator is useful for this whether or not the leading edge portion is cut while the portion is raised, or cut before or after the portion is raised.

After the paper applicator 250 is fully extended, as illustrated in FIG. 15C, the air cylinder 264 retracts the paper applicator to reposition it in its original position, illustrated in FIG. 15A. As the paper applicator 250 retracts, the roller 250 freely rotates counterclockwise, as viewed from the first side 160 of roll 22, over the top of the outer-most layer 34, preferably without disengaging the outer-most wrap 34 from the roll 22.

Although only one paper applicator 250 is illustrated, the apparatus 20A may include any number of paper applicators, including any combination of arms 252, rollers 260, and actuators 264, which may be interconnected to operate simultaneously.

In the embodiment of the paper applicator 250 described above, the paper applicator moves, while the roll 22 remains stationary. However, it is possible to obtain the same functions if the paper applicator remained stationary and the roll is 22 rotated relative to the applicator.

While one preferred embodiment of paper applicator 250 is illustrated in FIGS. 14 and 15A–15C, other embodiments are suitable so long as they perform the four functions. For example, a brush, a bar, a straight edge, or a pad attached to a similarly functioning actuator are suitable paper applicators.

Figure 16:
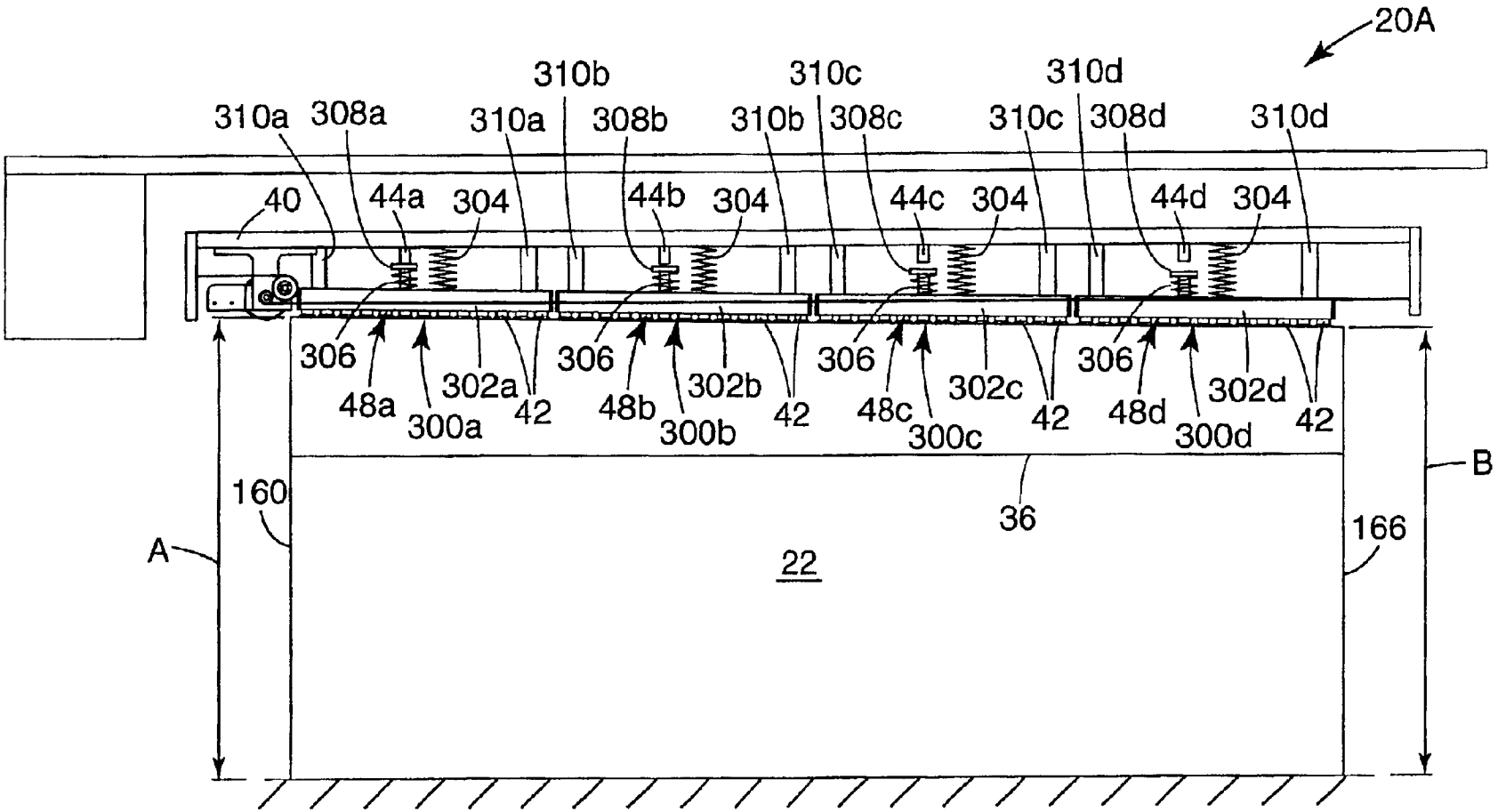
FIG. 16 illustrates a front schematic view of the alternative splicing tape applicator of FIG. 14, including an alternative sheet engagement mechanism.

FIG. 16 is convenient for describing the plurality of sheet engagement mechanisms 300. The splicing tape applicator 20A is illustrated as including four sheet engagement mechanisms 300. However, the splicing tape applicator 20A may include any number of sheet engagement mechanisms 300. The plurality of sheet engagement mechanisms 300 are convenient for use with rolls 22 that do not have the same diameter across the axial length of the roll 22. For example, the first side 160 of roll 22 may have a diameter of "A" and the second side 166 of the roll 22 may have "B", where the diameter A is greater than diameter B. In addition, the plurality of sheet engagement mechanisms 300 are useful if the roll 22 is on a tilted surface, as opposed to a flat surface. The plurality of sheet engagement mechanisms 300 are also convenient for use with rolls of varying "widths" or axial length.

Each sheet engagement mechanism 300*a*–300*d*, includes its own vacuum source (not shown), its own set of vacuum cups 42, its own spring 304, its own-sensor 44*a*–14*d*, and accompanying target 308*a*–308*d*. Preferably, each target is spring-loaded with a spring 306. Each sheet engagement mechanism 300 travels vertically along guides 310. After the roll 22 is placed below the sheet engagement mechanisms 300, the plurality of sheet engagement mechanisms 300 are lowered by motors (not shown) along guides 310 towards the roll 22. Because the roll 22 may have a varying diameter across the roll, some engagement mechanisms may contact the roll before others. This will cause the contacted mechanism to move long its guide and bring the target and sensor in contact with each other before other roll sensors have contacted their targets 308. For example, as illustrated in FIG. 16, the roll sensor 44*a* in the first sheet engagement mechanism 300*a* will contact its target 306 before the roll sensor 44*d* in the fourth sheet engagement mechanism 300*d* will contact its target 308*d*, because the first end 160 of the roll 22 has a larger diameter "A" in comparison to the diameter "B" of the second end 166 of the roll 22 and the roll 22 is sitting on a flat surface. Once the sensors 44 contact their targets 306, the sheet engagement mechanisms 300 continue to move downward and thus, continue to push the sensors 44 down onto the spring-loaded targets, until all of the roll sensors 44*a*–44*d* have contacted their respective targets 308*a*–308*d*.

The roll sensors 44*a*–44*d* are preferably electrically connected to the programmable controller (not shown), and provide a signal thereto upon contacting the targets 308*a*–308*d*. Upon receiving a signal from all four of the roll sensors 44, the programmable controller initiates the vacuum source (not shown) to form a vacuum at the desired vacuum cups 42. Thus, the roll sensors 44 serve as a switching mechanisms, ensuring that processing of the roll 22 by the applicator begins only after the vacuum cups 42 in each of the mechanisms 300 are properly positioned relative to the roll 22 to allow all of the sheet engagement mechanisms to lift the outer-most sheet 34 simultaneously. As such, the applicator 20 can handle a number of varying roll diameters throughout the same roll 22.

In a preferred embodiment, the vacuum cups 42 are arranged in a plurality of zones 48*a*–48*d*, one zone for each sheet engagement mechanism 300*a*–300*d*. With this zoned configuration, the sheet engagement mechanisms 300 are able to readily process a variety of different roll "widths" (or axial length). As a point of reference, for many printing industry applications where the roll 22 is a comprised of a paper sheet material, "standard" roll widths (or axial length) include 12.25 inches (31.1 cm), 24.5 inches (62.2 cm), and 50 inches (127 cm). The actual width of the roll 22 will dictate which of the plurality of sheet engagement mechanisms 300, including their respective zones 48, are activated. For example, where the roll 22 has a width of 50 inches (127 cm), the vacuum cups 42 in all of the sheet engagement mechanisms 300*a*–300*d* (zones 48*a*–48*d*) will be used (e.g., have a vacuum applied thereto). Conversely, a roll width of 12.25 inches (31.1 cm) requires that only the first sheet engagement mechanism 300*a* (zone 48*a*) be activated. In this regard, a separate programmable controller (not shown) is preferably provided to initiate a vacuum at the desired zones 48*a*–48*d*.

Figure 5:
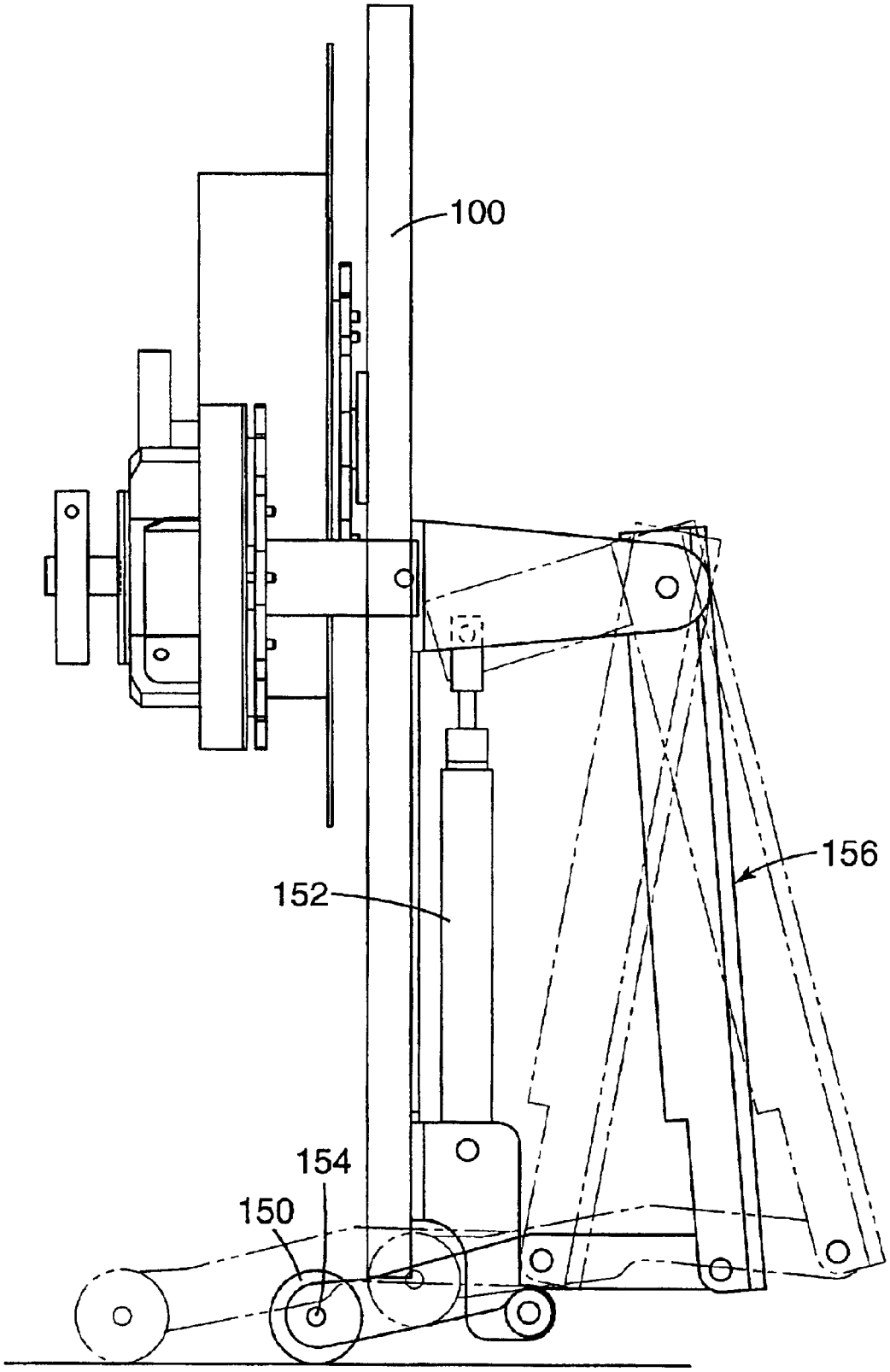
FIG. 5 is an enlarged, rear view of the taping device of FIG. 3.
Figure 6A:
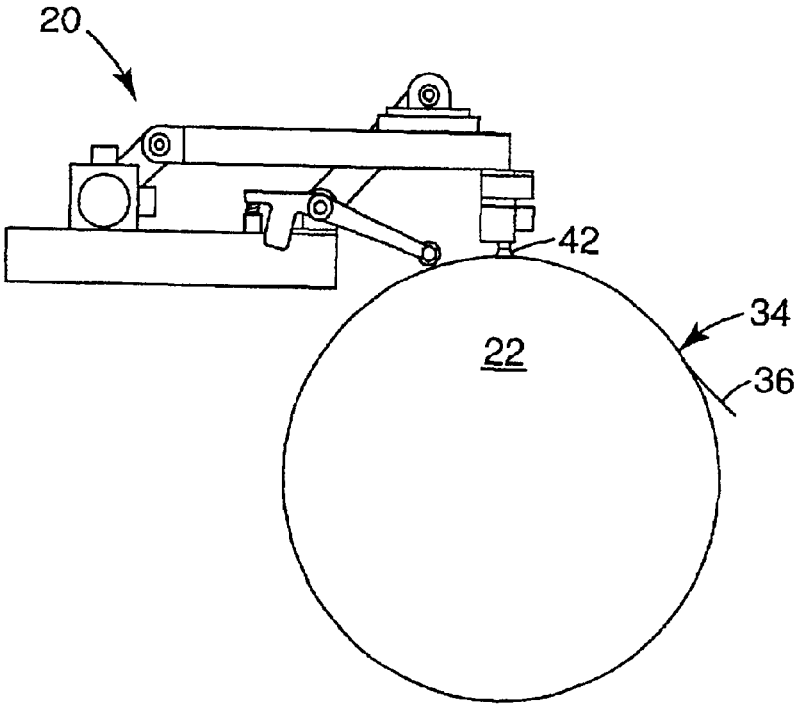
FIG. 6A–13B illustrate operation of the applicator of FIGS. 1A and 1B in accordance with a method of the present invention.
Figure 6B:
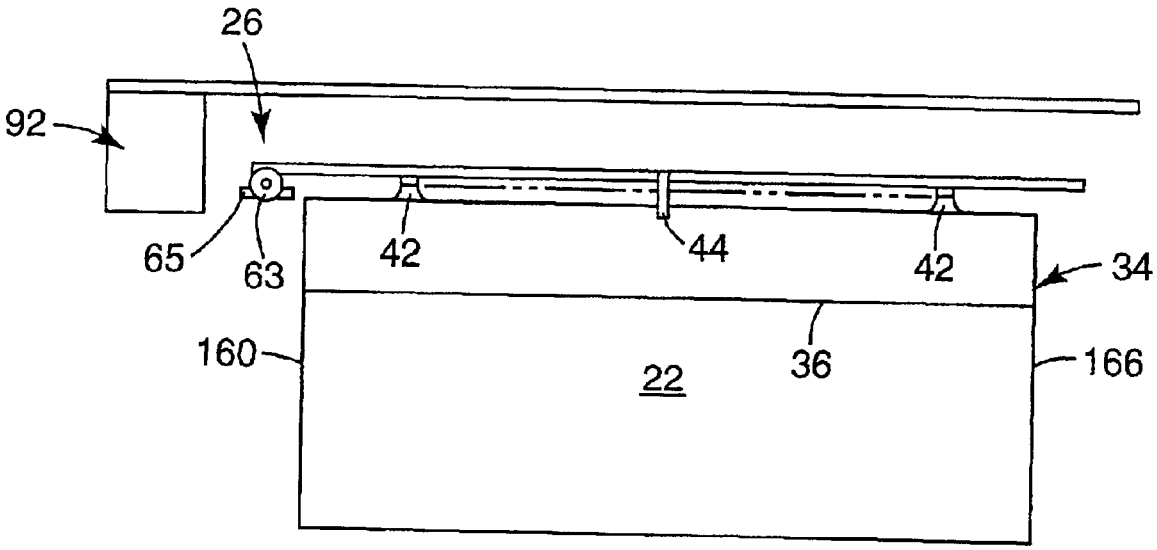
Figure 17:
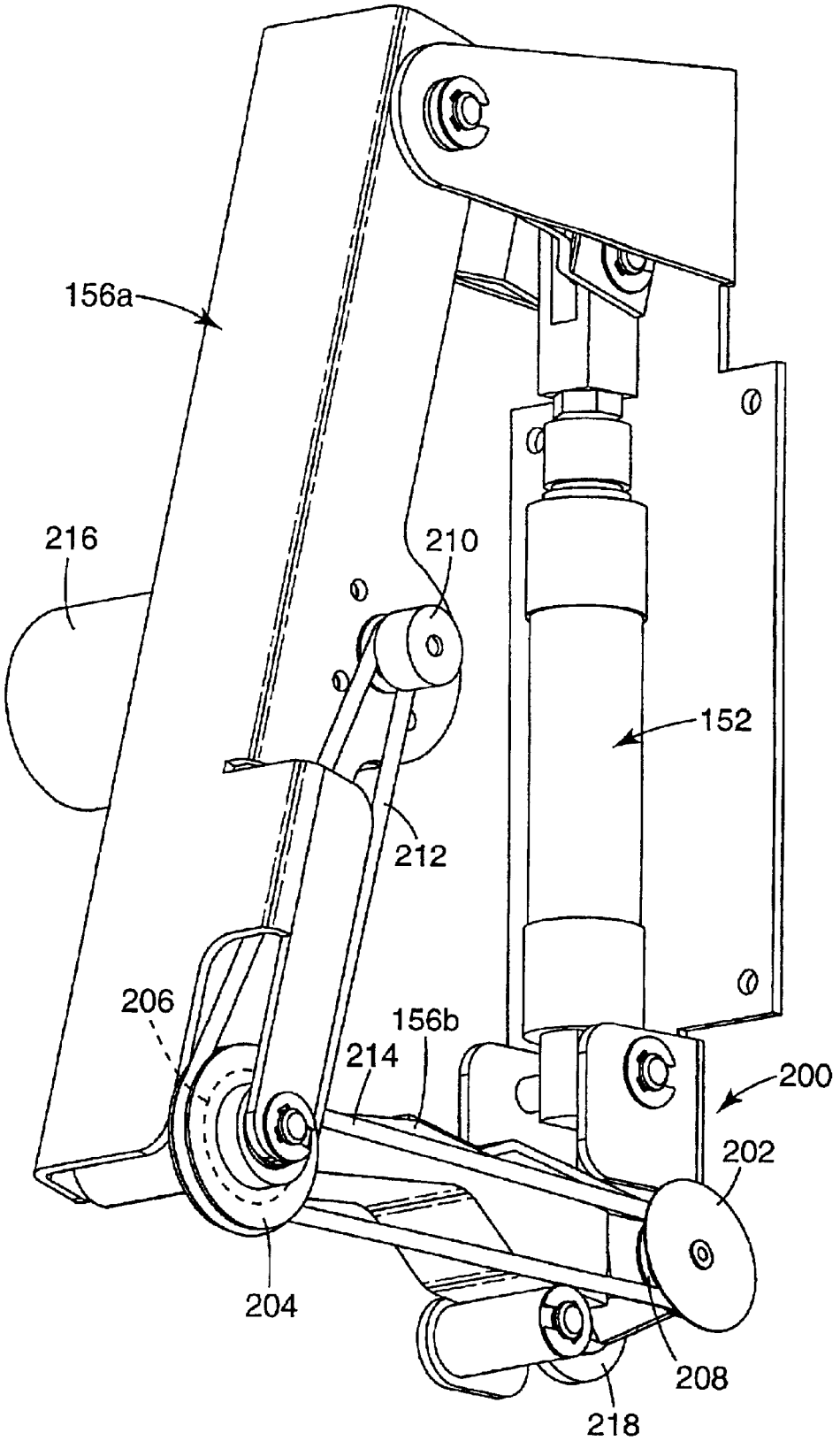
FIG. 17 illustrates an alternative tape cutter for cutting the splicing tape.

FIG. 17 illustrates an alternative tape cutter 200 for use with the actuator mechanism 152 and links 154 described with respect to and illustrated in FIG. 5. Tape cutter 200 provides a blade or cutter 202 for cutting the splicing tape 102. The blade 202 is rotated by a series of pulleys 204, 206, 208, belts 212, 214 and a motor 216. The motor 216 is attached to the middle of link 156*a*. A drive pulley 210 is mounted on the link 156*a* opposite the motor 216. A first pulley 204 is mounted at the intersection of the link 156*a* and link 156*b*. A first belt 212 runs between the drive pulley 210 and the first pulley 204. A second pulley 206 is mounted between the first pulley 204 and the intersection of the link 156*a* and link 156*b*. A third pulley 208 is mounted on the link 156*b* opposite the second pulley 206. A second belt 214 runs between the second pulley 206 and the third pulley 208. The blade 202 is mounted on the third pulley 208.

As the motor 216 rotates, it turns the drive pulley 210. As the drive pulley 210 rotates, the first belt 212 rotates the first pulley 204. As the first pulley 204 rotates, the second pulley 206 rotates. As the second pulley 206 rotates, the second belt rotates the third pulley 208. As the third pulley 208 rotates, the blade 202 rotates to cut the tape. This alternative cutter 200 is driven and as a result, cuts more easily through the splicing tape and its accompanying liner in comparison to the tape cutter 94 described with respect to and illustrated in FIGS. 1A–3B, which is not driven.

Although the present invention has been described with reference to preferred embodiments, workers skilled in the art will recognize that changes can be made in form and detail without departing from the spirit and scope of the present invention. For example, the tape cutter has been preferably described as including a rotary cutter and an actuator mechanism. A variety of other tape cutter designs known in the art may also be employed. Further, the applicator has been described as applying a separable splicing tape having a pre-cut release liner and two tape elements. A wide variety of other splicing tapes can also be applied with the present invention.

What is claimed is:

1. An apparatus for applying a splicing tape to a roll of sheet material, the apparatus comprising:

a plurality sheet engagement mechanisms to lift an outer-most layer of the roll to form a lifted portion of the outer-most layer, wherein each sheet engagement mechanism includes a vacuum source and a roll sensor for sensing a spatial position of the roll relative to the sheet engagement mechanism, wherein each vacuum source only operates when a selected plurality of the roll sensors sense the roll, a taping device to apply a slicing tape to the roll; and a paper applicator to apply pressure to the lifted portion of the outer-most layer to progressively place the lifted portion of the outer-most layer in contact with the remainder of the roll and the splicing tape.

2. The apparatus of claim 1, wherein the paper applicator applies pressure to disengage the lifted portion from the sheet engagement mechanism.

3. The apparatus of claim 1, wherein the paper applicator includes a roller for rolling along the lifted portion of the outer-most layer from the sheet engagement mechanism and to progressively press the roller along the outer-most layer and the splicing tape.

4. The apparatus of claim 1, further comprising:

a sheet cutter to cut the outer-most layer of the roll across a width thereof.

5. The apparatus of claim 1, wherein the sheet engagement mechanism includes a vacuum source for lifting the portion of the outer-most layer away from the remainder of the roll.

6. The apparatus of claim 1, wherein the paper applicator holds down a portion of the outer-most layer as the lifted portion of the outer-most layer is lifted away from the remainder of the roll by the sheet engagement mechanism.

7. The apparatus of claim 1, wherein the splicing tape has a first section and a second section, wherein the outer-most layer covers the first section of the splicing tape and the second section of the splicing tape remains exposed adjacent the outer-most layer.

8. The apparatus of claim 1, wherein the taping device further includes a press down roller for pressing the outer-most layer against an outer surface of splicing tape after the paper applicator applies the lifted portion of the outer-most layer to the splicing tape.

9. The apparatus of claim 1, wherein each sheet engagement mechanism includes a plurality of vacuum cups.

10. An apparatus for applying a splicing tape to a roll of sheet material, the apparatus comprising:

a sheet engagement mechanism to lift an outer-most layer of the roll to form a lifted portion of the outer-most layer;

a taping device to apply a slicing tape to the roll;

a paper applicator to apply pressure to the lifted portion of the outer-most layer to progressively place the lifted portion of the outer-most layer in contact with the remainder of the roll and the splicing tape; and a press down roller for pressing the outer-most layer against an outer surface of splicing tape after the paper applicator applies the lifted portion of the outer-most layer to the splicing tape.

* * * * *

UNITED STATES PATENT AND TRADEMARK OFFICE

CERTIFICATE OF CORRECTION

PATENT NO. : 6,814,123 B2
APPLICATION NO. : 10/028659
DATED : November 9, 2004
INVENTOR(S) : Leif O. Erickson It is certified that error appears in the above-identified patent and that said Letters Patent is hereby corrected as shown below:

Column 2,
Line 16, delete "outermost" and insert in place thereof -- outer-most --.

Column 12,
Line 2, delete "outermost" and insert in place thereof -- outer-most --.

Column 14,
Line 28, delete "FIG. 11B" and insert in place thereof -- FIG. 10B --.

Column 16,
Line 64, delete "44*a*-14*d*" and insert in place thereof -- 44*a*-44*d* --.

Column 18,
Line 31, insert -- of -- following "plurality".
Line 38, delete "roll," and insert in place thereof -- ; --.
Line 39, delete "slicing" and insert in place thereof -- splicing --.

Column 20,
Line 1, delete "slicing" and insert in place thereof -- splicing --.

Signed and Sealed this

Sixteenth Day of January, 2007

JON W. DUDAS
*Director of the United States Patent and Trademark Office*